US009046850B2

(12) United States Patent
Hirai et al.

(10) Patent No.: US 9,046,850 B2
(45) Date of Patent: Jun. 2, 2015

(54) IMAGE FORMING APPARATUS CAPABLE OF REDUCING IMAGE DENSITY IRREGULARITY

(75) Inventors: Shuji Hirai, Tokyo (JP); Satoshi Kaneko, Kanagawa (JP); Shinji Kato, Kanagawa (JP); Jun Yamane, Kanagawa (JP); Koichi Kudo, Kanagawa (JP); Shingo Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 172 days.

(21) Appl. No.: 13/361,431

(22) Filed: Jan. 30, 2012

(65) Prior Publication Data

US 2012/0201552 A1 Aug. 9, 2012

(30) Foreign Application Priority Data

Feb. 4, 2011 (JP) ..... 2011-022284
Mar. 30, 2011 (JP) ..... 2011-076200

(51) Int. Cl.
*G03G 15/00* (2006.01)

(52) U.S. Cl.
CPC .... *G03G 15/5058* (2013.01); *G03G 2215/0116* (2013.01); *G03G 2215/0129* (2013.01); *G03G 2215/0141* (2013.01)

(58) Field of Classification Search
CPC ..... G03G 15/0266; G03G 15/0275
USPC ..... 399/49, 72
See application file for complete search history.

(56) References Cited

U.S. PATENT DOCUMENTS

| | | | |
|---|---|---|---|
| 5,493,382 | A | 2/1996 | Takagaki et al. |
| 5,765,059 | A | 6/1998 | Kosuge et al. |
| 5,970,276 | A | 10/1999 | Kato |
| 6,141,520 | A | 10/2000 | Kosuge |
| 6,336,008 | B1 | 1/2002 | Nakazato et al. |
| 6,341,203 | B1 | 1/2002 | Nakazato et al. |
| 6,483,997 | B1 | 11/2002 | Nakazato |
| 6,597,881 | B2 | 7/2003 | Hatori et al. |

(Continued)

FOREIGN PATENT DOCUMENTS

| | | |
|---|---|---|
| JP | 62-145266 | 6/1987 |
| JP | 9-62042 | 3/1997 |

(Continued)

OTHER PUBLICATIONS

Office Action issued in Japanese Patent Application No. 2011-076200 on Jan. 6, 2015.

(Continued)

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

In an image forming apparatus, a first controller forms a first image pattern on an image bearer and determines a first image formation condition based on a detection result of density of a toner image. The first controller then controls a toner image forming device based on the first image formation condition. A second controller forms a second image pattern different from the first image pattern on an image bearer and determines a second image formation condition based on a detection result of density of a toner image. The second controller then controls a toner image forming device based on the second image formation condition.

19 Claims, 17 Drawing Sheets

(56) References Cited

U.S. PATENT DOCUMENTS

| | | | | |
|---|---|---|---|---|
| 6,757,512 | B2 | 6/2004 | Miyawaki et al. | |
| 7,003,238 | B2 | 2/2006 | Yoshida et al. | |
| 7,343,126 | B2 | 3/2008 | Miyawaki et al. | |
| 7,435,946 | B2 | 10/2008 | Kudo et al. | |
| 7,526,230 | B2 | 4/2009 | Kudo et al. | |
| 7,532,370 | B2 | 5/2009 | Kudo et al. | |
| 7,583,919 | B2 | 9/2009 | Suzuki et al. | |
| 7,616,909 | B2 | 11/2009 | Kato et al. | |
| 7,639,957 | B2 | 12/2009 | Kato et al. | |
| 7,693,466 | B2 | 4/2010 | Miyawaki et al. | |
| 7,821,677 | B2 | 10/2010 | Tanaka et al. | |
| 7,853,189 | B2 | 12/2010 | Kamoshita et al. | |
| 7,929,873 | B2 | 4/2011 | Takeuchi et al. | |
| 8,027,605 | B2 | 9/2011 | Takeuchi et al. | |
| 8,068,759 | B2 | 11/2011 | Takehara et al. | |
| 2002/0003967 | A1 | 1/2002 | Okada | |
| 2002/0028085 | A1 | 3/2002 | Nakazato et al. | |
| 2002/0037175 | A1 | 3/2002 | Nakazato et al. | |
| 2002/0110381 | A1* | 8/2002 | Maebashi et al. | 399/49 |
| 2002/0127488 | A1* | 9/2002 | Suzuki et al. | 430/124 |
| 2003/0012578 | A1* | 1/2003 | Ishii et al. | 399/49 |
| 2004/0052554 | A1* | 3/2004 | Harada et al. | 399/301 |
| 2005/0135822 | A1* | 6/2005 | Nakagawa | 399/49 |
| 2005/0286916 | A1 | 12/2005 | Nakazato et al. | |
| 2007/0052991 | A1* | 3/2007 | Goodman et al. | 358/1.12 |
| 2007/0127937 | A1 | 6/2007 | Ichikawa et al. | |
| 2008/0279599 | A1* | 11/2008 | Nagatsuka | 399/301 |
| 2009/0046325 | A1* | 2/2009 | Paul et al. | 358/3.26 |
| 2010/0111547 | A1 | 5/2010 | Kawamoto et al. | |
| 2010/0158551 | A1* | 6/2010 | Shirakata et al. | 399/66 |
| 2010/0183323 | A1 | 7/2010 | Fujiya et al. | |
| 2010/0232819 | A1 | 9/2010 | Kudo et al. | |
| 2010/0290799 | A1 | 11/2010 | Komiya | |
| 2011/0058823 | A1 | 3/2011 | Hirai | |
| 2011/0081155 | A1* | 4/2011 | Matsumoto et al. | 399/50 |
| 2011/0229171 | A1 | 9/2011 | Hirai | |

FOREIGN PATENT DOCUMENTS

| | | |
|---|---|---|
| JP | 11-258873 | 9/1999 |
| JP | 2000-98675 | 4/2000 |
| JP | 2002-23471 | 1/2002 |
| JP | 2005-326890 | 11/2005 |
| JP | 2006-106556 | 4/2006 |
| JP | 2007-156192 | 6/2007 |
| JP | 2010-266594 | 11/2010 |

OTHER PUBLICATIONS

Japanese Office Action issued in Japanese Patent Application No. 2011-022284 on Sep. 26, 2014.

* cited by examiner

BLACK TONER ATTRACTED AMOUNT DETECTOR

COLOR TONER ATTRACTED A MOUNT DETECTOR

DENSITY SENSOR OUTPUT

PHOTOCONDUCTOR CYCLE AVERAGE

IMAGE FORMING APPARATUS CAPABLE OF REDUCING IMAGE DENSITY IRREGULARITY

CROSS-REFERENCE TO RELATED APPLICATION

This patent application is based on and claims priority pursuant to 35 U.S.C. §119 to Japanese Patent Application Nos. 2011-022284 and 2011-076200, filed on Feb. 4 and Mar. 30, 2011, respectively, in the Japanese Patent Office, the entire disclosures of which are hereby incorporated by reference herein.

BACKGROUND OF THE INVENTION

1. Field of the Invention

This invention relates to an image forming apparatus, such as a copier, a printer, a facsimile machine, a printer, etc.

2. Description of the Related Art

Conventionally, image forming apparatuses are known that reduce density irregularity of a toner image formed on an image bearer.

For example, Japanese Patent Publication No. 62-145266 (JP-S62-145266-A) discloses a technology in which an image recorder (i.e., an image forming apparatus) scans a modulated laser beam onto a photoconductive drum (i.e., an image bearer) to record a latent image thereon and then applies an electro-photographic process thereto to execute development and transfer processes to obtain an output of an image. Prior to such an image output, the recorder records a solid black image on the photoconductive drum and reads the solid black image to obtain information that is read and stored in a memory to correct image density at each recording position based on the information read and stored.

Japanese Patent Publication No. 09-62042 (JA-H09-62042-A) discloses an image forming apparatus that reduces density irregularity periodically occurring on an image by controlling at least one of several formation conditions including a charging voltage, a light exposure amount, a developer voltage, or a transfer voltage based on data on periodic fluctuations of image density or a charge potential on an image bearer, each of which has been previously stored. Such periodic fluctuation data used in controlling an image formation condition is measured beforehand based on a single type of image data (e.g. a solid image) in the image forming apparatus.

Japanese Patent No. 3825184 (JP-3825184-B) discloses an image forming apparatus that detects a rotation cycle of a developing roller with a developing roller cycle detector and detects an amount of irregularity of toner density in a pattern formed on an image bearer. The image forming apparatus then controls a developing bias by matching a phase of an output signal from the above-described density irregularity amount detector with that of an output signal from the developing roller rotation cycle detector. Accordingly, the density irregularity of the solid image can be corrected by varying the development potential during the above-described developing bias control process executed in the image forming apparatus.

Japanese Patent Publication No. 2006-106556 (JP-2006-106556-A) also discloses an image forming apparatus that forms a test image on an image bearer or a transfer medium, and detects a frequency of image density irregularity periodically occurring thereon. The image forming apparatus then identifies a source of the image density irregularity based on the detected frequency to control an operation of the source thereof to reduce image density irregularity.

However, image density irregularity cannot be reduced completely across multiple different types of images of varying image densities (for example, a solid image and a halftone image) by the above-described approaches. For example, with the image forming apparatus of JP-62-145266-A, density irregularity of a halftone image cannot be reduced and is worse when it is formed, although density irregularity of a solid image can be reduced because those are corrected based on information read from a solid black image. Further, periodic variation data, such as image density, etc., used in controlling an image formation condition is measured based on image data of a single type image (for example, a solid image) in the image forming apparatus of JP-09-62042-A. However, a profile of irregularity of image density is sometimes slightly different depending on the level of image density (e.g. a level of a solid image portion or that of a halftone image portion). Further, in the image forming apparatus of JP-3825184-B, since a development potential is changed by controlling a developing bias, thereby changing a background potential at the same time, a halftone image is affected by fluctuation of the background potential and fluctuates unexpectedly. Therefore, it works well to correct the density of the solid image but not that of the half-tone image. Further, in the image forming apparatus of JP-2006-106556-A, when a frequency of periodic density irregularity in each of solid and halftone images is detected, similar frequency property is probably detected even if a source of generation of density irregularity is different in each of the images. In such a situation, the source of generation of density irregularity of each of the images may not be accurately identified, so that the density irregularity cannot be reduced appropriately.

BRIEF SUMMARY OF THE INVENTION

Accordingly, the present invention provides a novel image forming apparatus comprising an image bearer to bear an image, a toner image forming device to form a toner image on the image bearer, and a density detector to detect density of a toner image formed the image bearer. A first controller is provided to form a first image pattern on the image bearer. The first controller determines a first image formation condition based on a detection result of density of the toner image, and controls the toner image forming device based on the first image formation condition. A second controller is provided to form a second image pattern different from the first image pattern on the image bearer. The second controller determines a second image formation condition based on a detection result of density of the toner image, and controls the toner image forming device based on the second image formation condition.

In another aspect, the second controller forms the second image pattern of the toner image formed on condition that the toner image forming device is (has been) controlled by the first controller based on the first image formation condition.

In yet another aspect, the toner image forming device forms the toner image by charging a surface of the image bearer, exposing the surface with charge thereby forming a latent image, and developing the latent image into a toner image thereon. Densities of the first and second image pattern are different from each other and each of the first and second image patterns has a single density. The first or second image formation condition determined based on the first or second image pattern on the higher density side at least is a developing or exposing condition. The other first or second image formation condition determined based on the first or second image pattern on the lower density side at least includes a charging condition.

In yet another aspect, a first sequential process of toner image formation of the first image pattern, density detection of the first image pattern, determination of the first image formation condition, and controlling of the toner image formation based on the first image formation condition, and a second sequential process of toner image formation of the second image pattern, density detection of the second image pattern, determination of the second image formation condition, and controlling of the toner image formation based on the second formation condition are repeated plural times.

In yet another aspect, a rotation position detector is provided to detect the rotational position of a rotating member serving as an image irregularity generation source. The first and second image formation conditions are determined synchronizing with a detection signal generated by the rotation position detector.

In yet another aspect, a rotation position detector is provided to detect the rotational position of a rotating member serving as an image irregularity generation source. The first and second image formation conditions are determined synchronizing with a detection signal generated by the rotation position detector.

In yet another aspect, a transfer device is provided to transfer a toner image formed on the image bearer onto a recording medium. A sequential process of the toner image formation, the density detection, and the determination of the image formation condition based on the detection result is executed each time a prescribed number of the toner images are transferred onto recording mediums.

In yet another aspect, an environmental condition change detector is provided to detect an environmental change. A sequential process of the toner image formation, the density detection, and the determination of the image formation condition based on the detection result is executed each time environment changes in the image forming apparatus.

In yet another aspect, an image forming apparatus comprises an image bearer, an exposing device to form a latent image on the image bearer, and a rotation position detector to detect a rotational position of the image bearer. Multiple developing rollers are provided. A developing device is provided to visualize the latent image borne on the image bearer. A density irregularity detector is provided to detect periodic density irregularity of an image borne on the image bearer. The image is longer than a circumference of the image bearer. A storage device is provided to store density irregularity information detected by the density irregularity density detector. A voltage controller is provided to control a voltage applied to each of the multiple developing rollers based on the detection data stored in the storage device.

In yet another aspect, the voltage controller applies voltages to the multiple developing rollers of the developing device with different phases from the other.

In yet another aspect, the voltage controller controls phases of voltages applied to the multiple developing rollers to enable a cycle of rotation of the image bearer to coincide with that of the voltages applied to the multiple developing rollers therein.

In yet another aspect, the voltage controller increasingly delays phases of the voltages applied to the multiple developing rollers in an order of arrangement in a downstream of a rotation direction of the image bearer.

In yet another aspect, the voltage controller includes a delay circuitry. A phase of a voltage applied to one of the multiple developing rollers arranged downstream in a rotation direction of the image bearer is delayed from that applied to another of the multiple developing rollers arranged up stream in the rotation direction via the delay circuitry.

In yet another aspect, the delay circuitry is arranged between a high voltage power source to provide a voltage and one of the multiple developing rollers located downstream in the rotation direction of the image bearer.

In yet another aspect, the voltage controller executes controlling while synchronizing with detection of the rotation position detector.

In yet another aspect, the multiple developing rollers are not electrically connected with each other.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
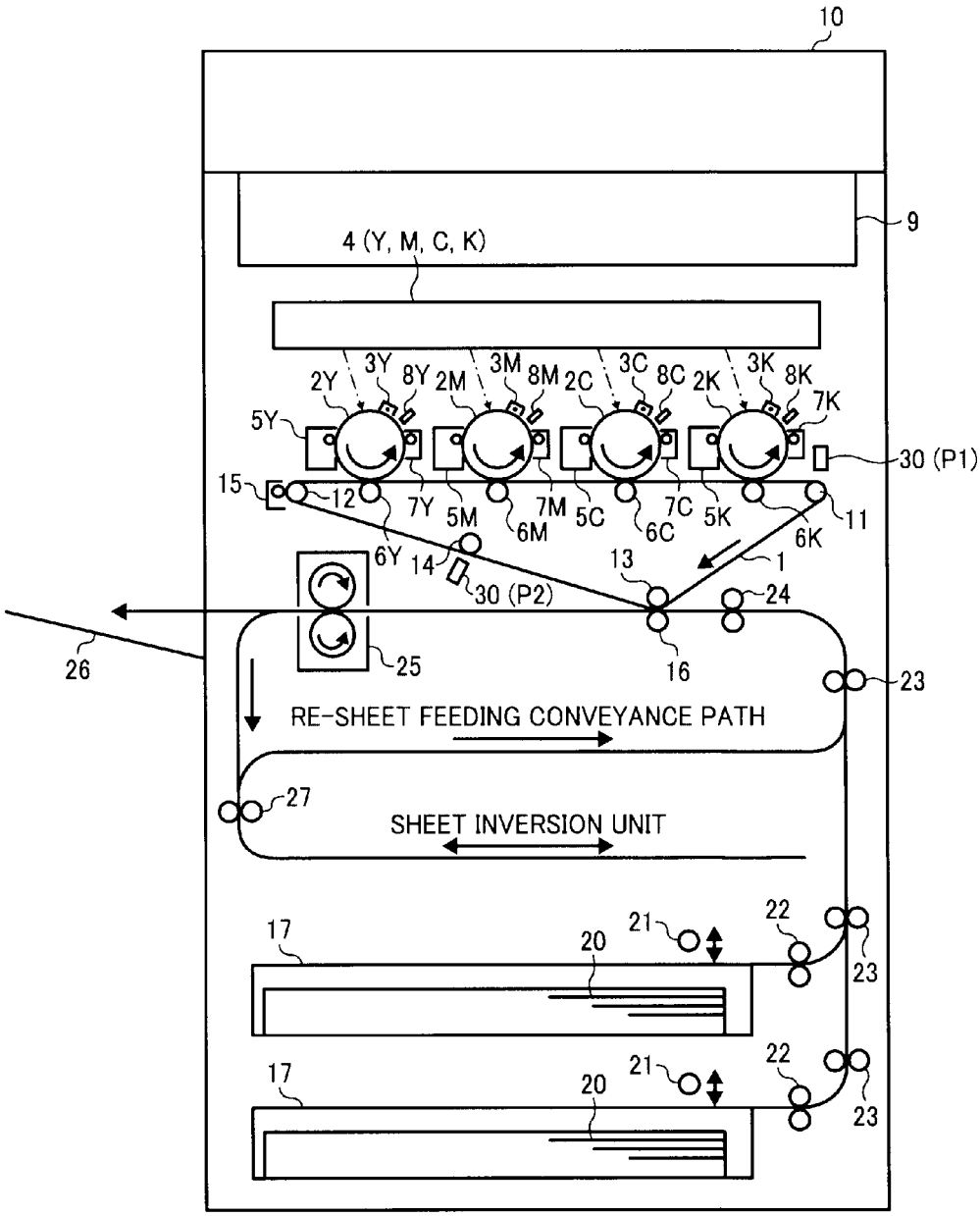
FIG. 1 is a schematic diagram showing a configuration of an image forming apparatus, to which the present invention is applicable.

Referring now to the drawings, wherein like reference numerals designate identical or corresponding parts throughout the several views thereof and in particular to FIG. 1, a configuration of an image forming apparatus, to which the present invention is applicable, is described. Although, FIG. 1 illustrates a full-color machine that employs a four-consecutive tandem type intermediate transfer system as an image forming apparatus of an electronic photographic system, to which the present invention is applicable, the present invention can be applied another imaging forming apparatus, such as a full-color machine employing a four tandem type direct transfer system, a full-color machine employing one-drum type intermediate transfer system, etc., as described later in detail. Further, the present invention can be applied to a monochrome machine, such as a machine employing a one-drum type direct transfer system, etc.

As shown in FIG. 1, multiple photoconductive drums 2Y, 2M, 2C and 2K as latent image bearers are arranged parallel to each other along an stretching plane (i.e., a stretching surface) of an intermediate transfer belt 1 serving as an intermediate transfer member as an image bearer. Appended references Y to K represent yellow, magenta, cyan, and black colors, respectively. An image formation station for yellow is typically explained herein after as a representative. Around a photoconductive drum 2Y, a charger 3Y as a charging device, an optical writing device 4Y as an exposing device, a development unit 5Y as a developing device, a primary transfer roller 6Y as a primary transfer device, a photosensitive member cleaning unit 7Y as a latent-image bearer cleaner, a quenching lamp 8Y as a charge remover are arranged in this order in a rotating direction thereof. A toner image forming device that forms a toner image on the intermediate transfer belt 1 as an image bearer is composed of the photoconductive drum 2Y, the charger 3Y, the optical writing unit 4Y, the developing unit 5Y, and a primary transfer roller 6Y or the like. The above-described configuration and operation are substantially the same in the remaining color image formation stations, as well. An ADF (Automatic Document Feeder) 10 as an automatic document feeding device and a scanner unit 9 as an image reader are located above the optical writing unit 4.

Multiple rollers 11, 12, and 13 as supporting members rotatably support an intermediate transfer belt 1. A belt cleaning unit 15 is located opposite the roller 12. A secondary transfer roller 16 as a transferring device is also located opposite the roller 13.

A sheet feeding tray 17 as a multiple sheet feeding unit is housed at a bottom of an apparatus body. One of recording sheets 20 as a printing medium accommodated in the tray is fed by a pickup roller 21 and a sheet feed roller 22, and is conveyed by a pair of conveyance rollers 23. The sheet 20 is then sent by a pair of registration rollers 24 to a secondary transfer station at a prescribed time. A fixing unit 25 as a fixing device is located downstream of a secondary transfer station in a sheet transporting direction. Reference numerals 26 and 27 indicate a sheet ejection tray and a pair of switchback rollers, respectively, in FIG. 1.

Now, an image formation operation executed by the configuration of FIG. 1 is briefly described. When a print instruction to begin printing enters, multiple rollers disposed around the photoconductive drum and the intermediate transfer belt and those on the sheet transport path or the like start rotating at a default timing, and start feeding a recording sheet from the sheet feeding tray located at the bottom of the apparatus.

On the other hand, a surface of each photoconductive drum 2 is charged with a uniform potential by the charger 3, and is exposed by an optical writing light emitted from the optical writing unit 4 according to image data. A potential pattern remaining after the exposure serves as an electrostatic latent image. The surface of the photosensitive drum 2 bearing the electrostatic latent image is supplied with toner from the developing unit 5 to develop the electrostatic latent image borne on the photosensitive drum 2 to a specific color toner image. In the configuration of FIG. 1, the photoconductive drums 2 handle four component colors, so that toner images of yellow, magenta, cyan, and black (see, a color order depends on a system) are developed on the respective photoconductive drums 2.

The toner image developed in this way on each of the photoconductive drums 2 is transferred onto the intermediate transfer belt 1 under a primary transfer bias applied to a primary transfer roller 6 disposed opposite the photoconductive drum 2 and pressure created at a contact point on the intermediate transfer belt 1 as well. By repeating these primary transfer operations for four component colors at prescribed timings, a full-color toner image is formed on the intermediate transfer belt 1.

A full-color toner image formed on the intermediate transfer belt 1 is transferred onto a recording sheet 20 fed to a secondary transfer roller section by a pair of registration rollers 24 at a prescribed timing. At this moment, a secondary transfer process is executed under pressure and a secondary transfer bias applied to the secondary transfer roller 16. The full-color toner image transferred onto a surface of the recording sheet 20 is fixed when the recording sheet 20 passes through the fixing unit 25.

When a single-sided printing is executed, the sheet is linearly transported as is to an exit tray 26. When a two-sided printing is executed, the sheet is transported changing a flowing direction downwardly to a sheet inversion unit. The recording sheet 20 reached the sheet inversion unit goes out therefrom from the edge of the recording sheet 20 with its transfer direction being reversed here by a pair of switchback rollers 27 to the sheet inversion unit. Such an operation causes switchback, so that front and backsides of the recording sheet 20 are inverted (i.e., upside down) by this behavior. The recording sheet 20 thus inverted does not return to the fixing unit 25 and joins the original sheet feeding path via the sheet transport path. Like front surface printing, a toner image is transferred onto a backside thereof and exits after that through the fixing unit 25. Hence, such behavior serves as double-sided printing.

Now, operations executed at respective sections until the end are described below. The photoconductive drum 2 having passed the primary transfer station bears residual toner on its surface after the primary transfer process. The residual toner is removed by a photoconductor cleaning unit 7 composed of a blade and a brush, etc. Then, charge on the surface of the photoconductor is thoroughly uniformly eliminated by the quenching lamp (QL) 8 to prepare for a charging process of the next image formation. Further, the intermediate transfer belt 1 also bears residual toner on its surface after a secondary transfer process. However, a belt cleaning unit 15 composed of a blade and a brush removes the residual toner to also prepare for a transfer process of the next toner image formation.

The image forming apparatus of FIG. 1 has a toner image detector (i.e., an optical sensor unit) 30 configured by an optical sensor or the like to detect density of a toner image formed on an outer surface of the intermediate transfer belt 1. Density of various image patterns (for example, a first image pattern and a second image pattern as described later) formed on the surface of the intermediate transfer belt 1 may be detected by the toner image detector 30 to be used in correction control of image irregularity. Toner image detector 30 is disposed at a position P1 (i.e., upstream of a secondary transfer unit) opposite a part of the roller 11 winding the intermediate transfer belt 1 therearound as shown in FIG. 1. The toner image detector 30 can be placed at a position P2 of the secondary transfer station (i.e., a position downstream of the secondary transfer station). In such a situation (I.e., it is placed downstream of the secondary transfer station), the toner image detector 30 is placed opposite a roller 14, which is disposed inside the intermediate transfer belt 1, to prevent swaying thereof.

Among two kinds of a placement position of the above-described toner image detector 30, the position P1 upstream of the secondary transfer station enables detection of a toner image pattern on the intermediate transfer belt 1 before a secondary transfer process, and is frequently adopted if there is no machine layout limitation. Because, since a toner image of an image pattern for correction control can be detected immediately after formation thereof, a waiting time is short, while a device to bypass the toner image of the image pattern through the secondary transfer station can be omitted. However, many models employ a secondary transfer position immediately downstream of an image formation station of a fourth color (e.g. Black in FIG. 1). In such a situation, it is difficult to place the sensor at the above-described position P1 in view of a space. In such situation, the toner image detector 30 is disposed at a position P2 downstream of the secondary transfer station, and detects the toner image toner formed on the intermediate transfer belt 1 after the toner image is bypassed through the secondary transfer station. As a system to bypass the toner image through the secondary transfer station, a system of parting the secondary transfer roller 16, or that of applying a reverse bias to the secondary transfer roller 16 are exemplified, but is not particularly limited to one.

Figure 2:
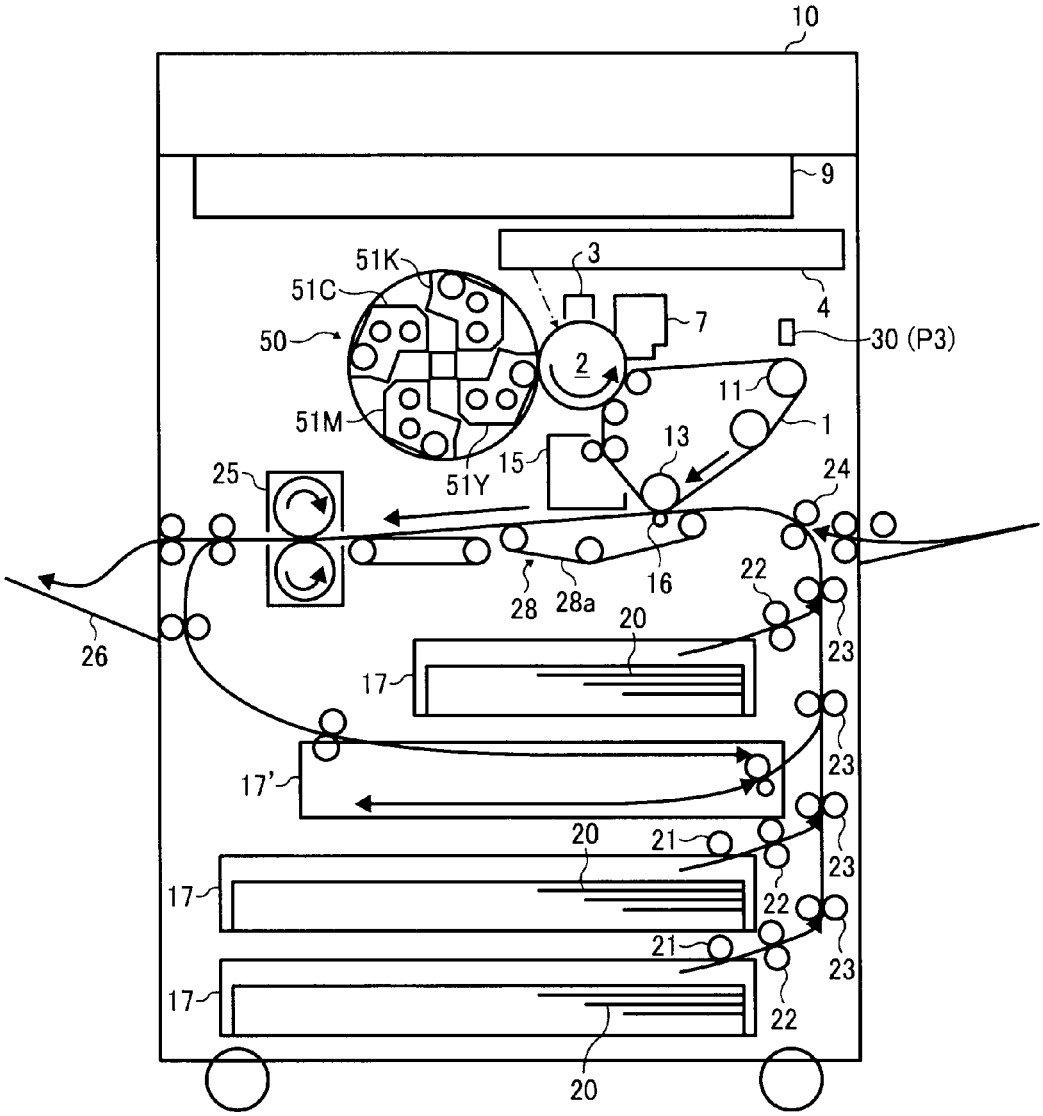
FIG. 2 is a schematic block diagram showing another configuration of an image forming apparatus, to which the present invention is applicable.

FIG. 2 is a schematic block diagram showing another applicable image forming apparatus of the present invention. In FIG. 2, same reference signs are added to similar members and devices to those of the image forming apparatus of FIG. 1, and descriptions of them are omitted. The image forming apparatus of FIG. 2 is a full-color machine employing a one-drum type intermediate transfer system, and composed of a drum-shaped photoconductive drum 2 and a revolver developing unit 50 opposed to the photoconductive drum 2. In the revolver development unit 50, a holder rotating around a shaft thereof holds four developing unit 51Y, 51M, 51C, and 51K. These development instruments develop electrostatic latent images on the photoconductive drum 2 with toner particles of yellow (Y), magenta (M), cyan (C), and black (K), respectively. In the revolver processing unit 50, an optional color developing unit among those of Y, M, C, and K can be moved to a developing position opposed to the photoconductive drum 2 by rotating the holder to develop the electrostatic latent image into an optional color on the photoconductive drum 2. When forming a full color image, electrostatic latent images for Y, M, C, and K are sequentially formed on the photoconductive drum 2, and are developed by the development instruments 51Y, 51M, 51C, and 51K one by one, respectively, in a process of circulating, for example, an endless intermediate transfer belt 1 about four times. Subsequently, the toner images of Y, M, C, and K colors thus obtained on the photoconductive drum 2 are sequentially transferred and overwrapped on the intermediate transfer belt 1. At the secondary transfer position, where the roller 13 supporting the intermediate transfer belt 1 is opposed to a secondary transfer roller 16 of a secondary transferal unit 28, the intermediate transfer belt 1 contacts a transfer conveyance belt 28*a* of the secondary transferal unit 28 creating a prescribed nip width, thereby forming a secondary transfer nip. When the four-color superimposed toner image borne on the intermediate transfer belt 1 passes through this secondary transfer nip, the same is transferred at once onto the recording sheet 20 as the recording medium transported by the transfer conveyance belt 28*a* of the secondary transfer unit 28 synchronizing with passage thereof therethrough as a secondary transfer process. When a two-sided image is formed on a recording sheet 20, the recording sheet 20 passing through a fixing unit 25 is conveyed to a duplex unit 17', so that front and backsides thereof are inverted by the duplex unit 17'. The recording sheet 20 thus inverted is then transported to above-described secondary transfer nip again, so that four-color superimposed toner image on the intermediate transfer belt 1 is transferred onto the back side of the recording sheet 20 at once during a secondary transfer process.

In an image forming apparatus of FIG. 2, the toner image detector 30 is located at a position P3 (i.e., upstream of the secondary transfer station) opposite a portion of the intermediate transfer belt 1 winding itself around the roller 11.

Figure 3:
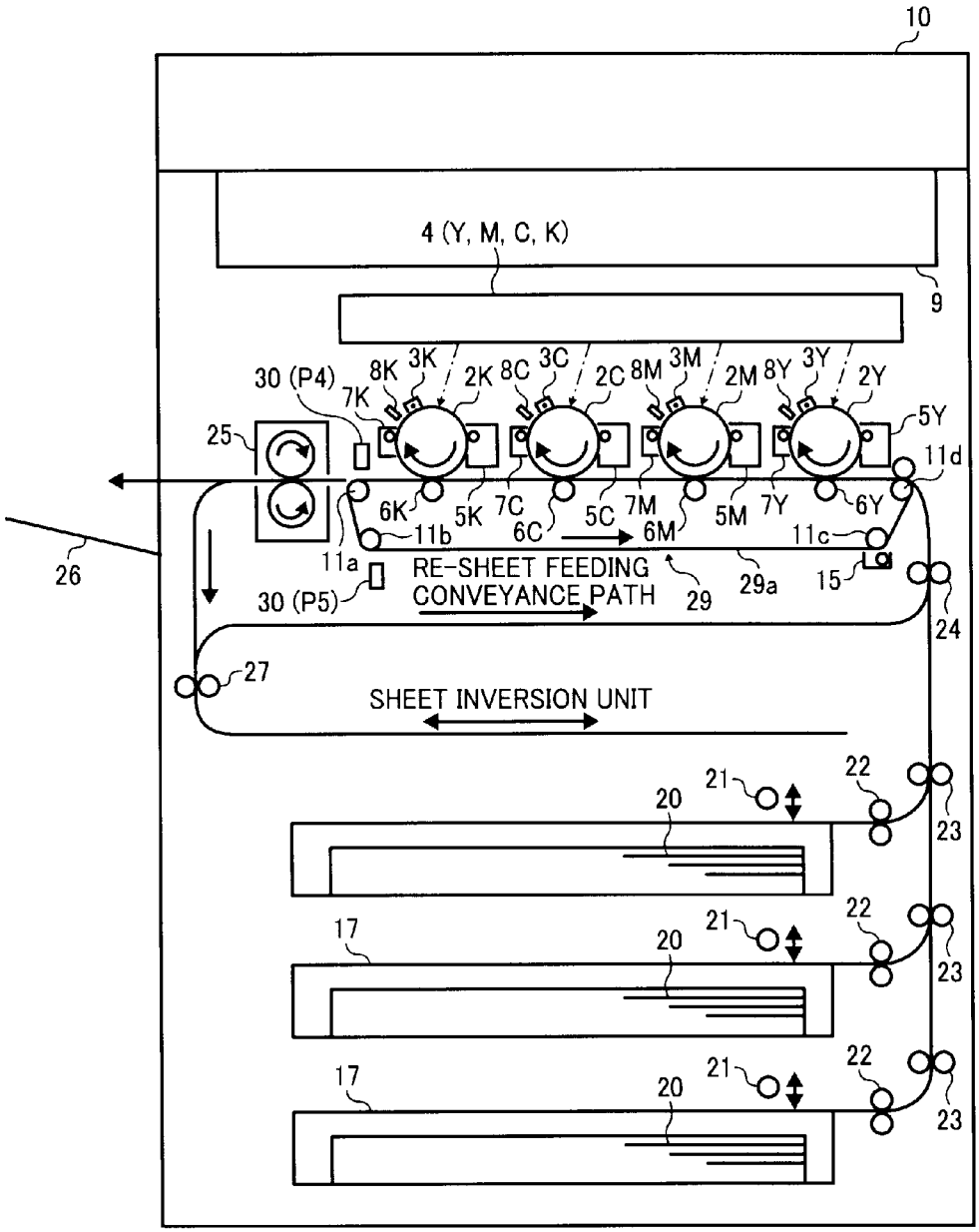
FIG. 3 is a schematic block diagram showing yet another configuration of an image forming apparatus, to which the present invention is applicable.

FIG. 3 is a schematic block diagram showing yet another image forming apparatus, to which the present invention is applicable. In FIG. 3, same reference signs as used in the image forming apparatus of FIG. 1 are added to similar members and devices thereof to omit repetitious description of them. The image forming apparatus of FIG. 3 is a full-color machine employing a four consecutive tandem type direct transfer system, which includes a transfer unit 29 below four units of image formation stations to transfer toner images formed on photoconductive drums 2Y, 2M, 2C, and 2K onto a recording sheet 20. This transfer unit 29 includes an endless transfer conveyance belt freely rotatably supported by multiple rollers 11*a* to 11*d* as supporting members. The transfer conveyance belt 29 is stretched around a driving roller 11*a* and driven rollers 11*b* to 11*d*, and is driven and rotated counterclockwise in the drawing at a prescribed time carrying the recording sheet 20 thereon to pass through each of transfer positions of image formation stations. Further, within a loop of the transfer conveyor belt 29*a*, there are provided multiple transfer rollers 6Y, 6M, 6C, and 6K to transfer the toner images from the photoconductive drums 2M, 2C, 2K, and 2Y to the recording sheet 20 at respective transfer positions, in which transfer electric fields are formed, respectively.

When a four color superposition mode is selected through an operation section, not illustrated in the image forming apparatus of FIG. 3, image formation processes are performed on the photoconductive drums 2Y, 2M, 2C, and 2K in the image formation stations to form toner images of respective colors synchronizing with transportation of the recording sheet 20. On the other hand, the recording sheet 20 fed from the sheet tray 17 is launched by a pair of registration rollers 24 at a prescribed time, and is held by transfer conveyance belt 29*a* to be conveyed passing through respective transfer positions of the image formation stations. The recording sheet 20 with the four color superposed image is fixed by the fixing unit 25 and is ejected onto the sheet exit tray 26.

In the image forming apparatus of FIG. 3, the toner image detector 30 is placed at a position P4 (i.e., upstream of a fixing device) opposite a portion of the transfer belt 29*a* winding itself around the roller 11*a* on the downstream most of the transfer units 29 in a recording sheet transport direction. Another toner image detector 30 is also placed at a position P5.

Further, in the image forming apparatus with the above-described configuration of from FIGS. 1 to 3, since a toner image of an image pattern for correction control is formed on the photoconductive drum 2 and is transferred onto a belt (e.g. an intermediate transfer belt 1 or a transfer conveyor belt 28*a*, 29*a*) disposed downstream, the toner image detector 30 can be placed opposite a surface of the photosensitive drum 2. In this situation, the toner image detector 30 can be positioned between a developing position of the developer unit 5 and a transfer position on the belt (i.e., the intermediate transfer belt 1 or the transfer conveyor belt 28*a*, 29*a*).

Now, correction control of density irregularity executed based on a detection result of density of an image pattern in the above-described image forming apparatus is described. However, although the blow described embodiments are typically applied to the image forming apparatus of FIG. 1, they can be applied to the image forming apparatuses of FIGS. 2 and 3.

Figure 4:
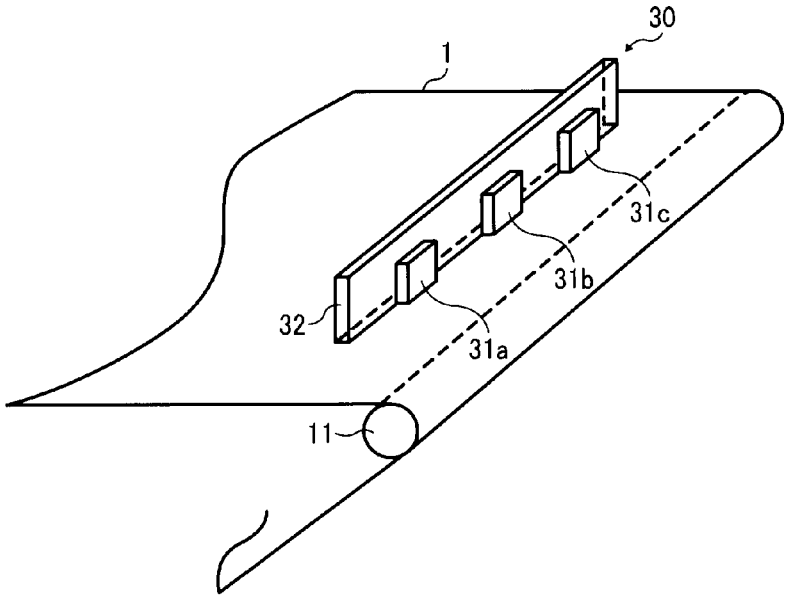
FIG. 4 is a partial perspective view showing an installation aspect of a toner image detector.

FIG. 4 is a perspective view partially showing an installation aspect of a toner image detector 30. FIG. 4 shows an example, in which a toner image detector (e.g. an optical sensor unit) 30 is located at a position P1 which is upstream of the secondary transfer station in the image forming apparatus of FIG. 1. The toner image detector 30 is a three head type in which three sensor heads (i.e., optical sensors) 31*a*, 31*b*, and 31*c* as density detection systems are mounted on a sensor substrate 32 (i.e., a toner image detector 30 has three-head product). Specifically, FIG. 4 shows a configuration example of the toner image detector 30 equipped with three sensors (optical sensors) disposed in a main scanning direction (i.e., an axial direction of a photoconductive drum 2) perpendicular to that a recording sheet is fed. Specifically, with this configuration, a toner attracted amount can be simultaneous measured at three positions in the main scanning direction (i.e., an axial direction of a photoconductive drum 2). However, the number of sensor heads of the toner image detector 30 is not limited to three as above. For example, the toner image detector 30 can be equipped with one or two sensor heads. Alternatively, the toner image detector 30 can be equipped with from four to seven sensor heads for different component colors.

Figure 5:
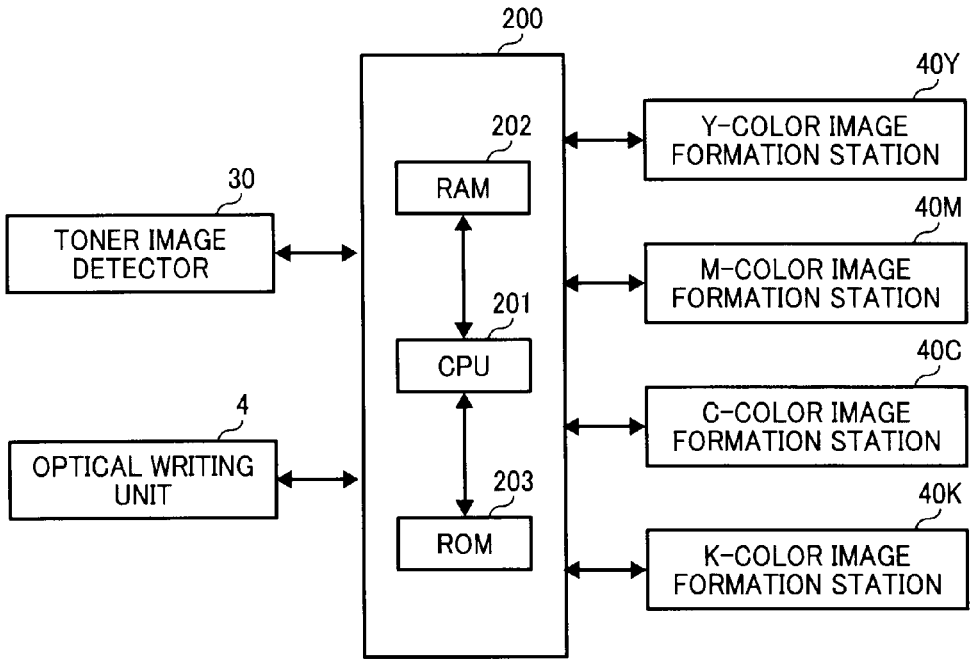
FIG. 5 is a block diagram of a control system of the image forming apparatus.

FIG. 5 is a block diagram showing an essential part of a control system of the image forming apparatus of this embodiment. A controller 200 of FIG. 9 serves as a controlling device and is mainly composed of a microcomputer 5 having a CPU (Central Processing Unit) 201 as an operation processing device, a RAM (Random Access Memory) 202 of a non-volatile memory as a storage device, and a ROM (Read Only Memory) or the like. To this controller 200, the image formation stations 40Y, 40M, 40C, and 40K, an optical writing unit 4, and a toner image detector (I.e., an optical sensor unit) 30 are electrically connected. The controller 200 controls these various instruments based on program stored in the RAM 202. The RAM 202 of the non-volatile memory stores output-converted data (e.g. conversion table) as output conversion information and output-conversion formula (i.e., algorithm) or the like used in calculating toner density (e.g. an amount of attracted toner) based on a detection value of each sensor head (i.e., an optical sensor) of the toner image detector 30 as described later in detail.

In addition, the controller 200 serves as first and the second controllers to optimize correction control of image density of each color every powering on or each time a predetermined number of printing operations has been completed. When acting as the first controller, the controller 200 forms a toner image of a first image pattern on the intermediate transfer belt 1 and determines a first image formation condition based on a detection result of density of the toner image, and controls the above-described toner image forming device based on the first image formation condition thus determined. When acting as the second controller, the controller 200 forms a toner image of a second image pattern different from the first toner image on the intermediate transfer belt 1, and determines a second image formation condition based on a detection result of density of the toner image, and controls the above-described toner image forming device based on the second image formation condition thus determined.

Figure 6:
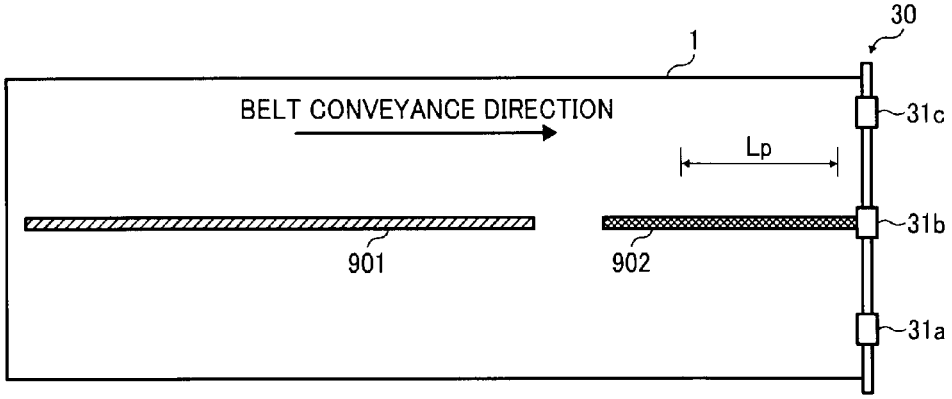
FIG. 6 illustrates first and second image patterns used in correcting irregularity of image density.

FIG. 6 illustrates exemplary first and second image patterns used in correction control of the above-described image density irregularity. FIG. 6 is an example, in which only a central sensor 31*b* of the toner image detector 30 with the configuration of FIG. 4 is used in image pattern detection. The belt state first and second image patterns 901 and 902 are sequentially formed facing the central sensor head 31*b* on a surface of the intermediate transfer belt 1 in this example. Each of the image patterns 901 and 902 is longer than that of a circumference Lp of a photosensitive member to be able to detect density irregularity occurring per cycle of the photoconductor. These first and second image patterns 902 and 901 thus successively formed have an identical shape with different density as an only difference. In such a situation, an area gradation system or an analog system may be used to differentiate the image density.

Figure 7:
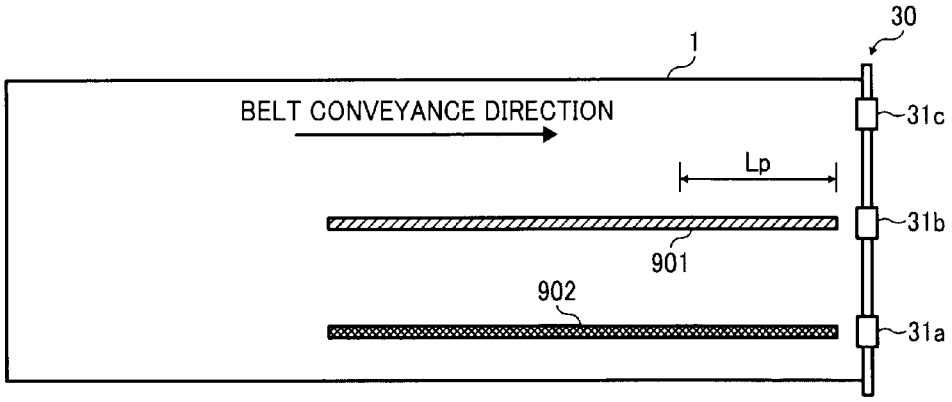
FIG. 7 illustrates another set of first and second image patterns used in correcting irregularity of image density.

FIG. 7 illustrates another exemplary first and second image patterns used in correction control of the above-described image density irregularity. In the example of FIG. 7, two (different) the sensor heads 31*a* and 31*b* with the above-described configuration of FIG. 4 are used in pattern image detection of as the toner image detector 30. As shown, the belt state first and second image patterns 901 and 902 are formed parallel to each other facing the two sensor heads 31*a* and 31*b*, respectively, on the outer surface of the intermediate transfer belt 1 in this example. Specifically, toner image formation and detection of the image patterns can be executed parallel in this situation.

Figure 8:
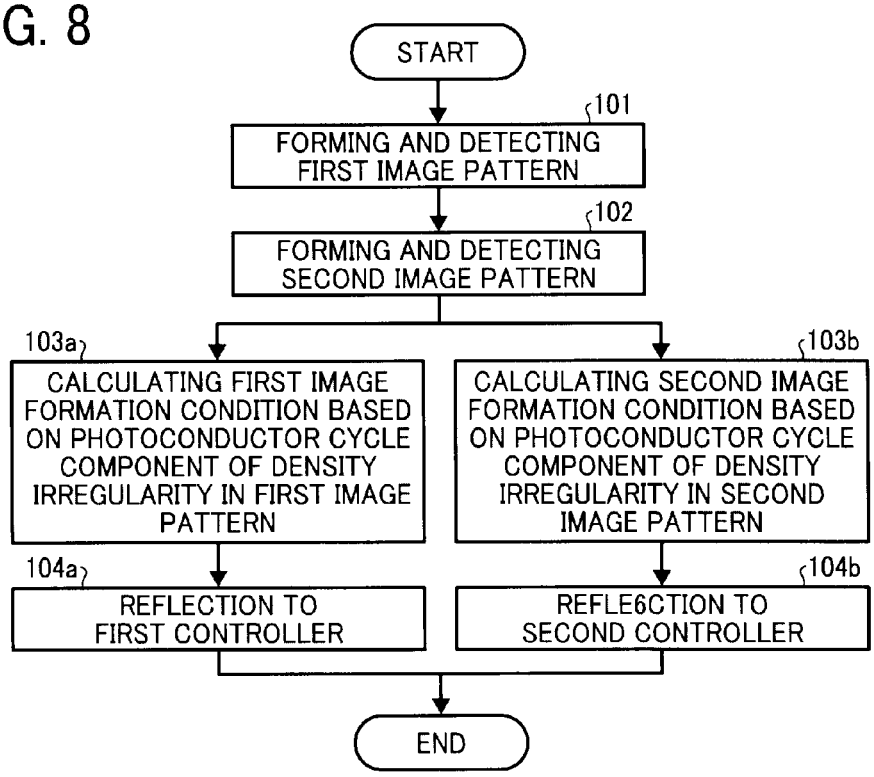
FIG. 8 is a flowchart showing correction control of density irregularity using the image patterns shown in FIG. 6.

FIG. 8 is a flowchart showing a sequence of correction control of density irregularity using image patterns 901 and 902 of FIG. 6 in the above-described image forming apparatus of FIG. 1. In this example of a control sequence, the toner images of the first second image patterns 901 and 902 are sequentially formed on the intermediate transfer belt 1, and are detected by the central sensor head 31*b* of the toner image detector 30 in steps S101 and S102. Specifically, the first image pattern formation and detection process (in step S101) and the second image pattern formation and detection process (in step S102) are executed sequentially.

After the above-described formation and detection of the image patterns 901 and 902 of the toner images, periodic components of the density irregularity in each of the image patterns corresponding to a rotation cycle of the photoconductive drum 2 are detect (i.e., extracted) based on the detection result. Then, based on the (photosensitive member) periodic components, image formation condition calculation processes are executed to determine image formation conditions in steps S103*a* and S103*b*, respectively. Image formation condition reflection processes are subsequently executed to reflect the thus calculated image formation conditions to the controller 200 (in steps S104*a* and step S104*b*). Each of the above-described image formation condition calculation processes may be processes to create a control table of an image formation condition in the controller 200. Further, each of the above-described imaging formation condition reflection processes may be processes to designate the control table used in controlling the above-described toner image forming device. Further, the above-described image formation condition calculation processes and the imaging formation condition reflection processes can be executed in parallel as shown in FIG. 8 or serially (i.e., by sequential processing).

Further, as shown in a control sequence of FIG. 8, the above-described image formation condition calculation processing operations (steps S103*a* and S103*b*) and the imaging formation condition reflection processing operations (steps S104*a* and S104*b*) are performed independently by the controller 200 in first and second (left and right) routes different from each other. Specifically, in the first route, after formation and detection of the first image pattern 901, the first image formation condition calculation process, in which the photoconductor periodic component of density irregularity of the first image pattern is detected (i.e., extracted) and the first image formation condition is determined based on the detection result (in step S103*a*) while the first image formation reflection process, in which the first image formation condition is reflected to the controller 200 functioning as a first controller (in step S104*a*), is performed. Whereas in the second route, after formation and detection of the second image pattern 902, the second image formation condition calculation process, in which the photoconductor periodic component of density irregularity of the second image pattern is detected (i.e., extracted) and the second image formation condition is determined based on the detection result (in step S103*b*) while the second image formation reflection process, in which the second image formation condition is reflected to the controller 200 functioning as a second controller (in step S104*b*), is performed.

Figure 9:
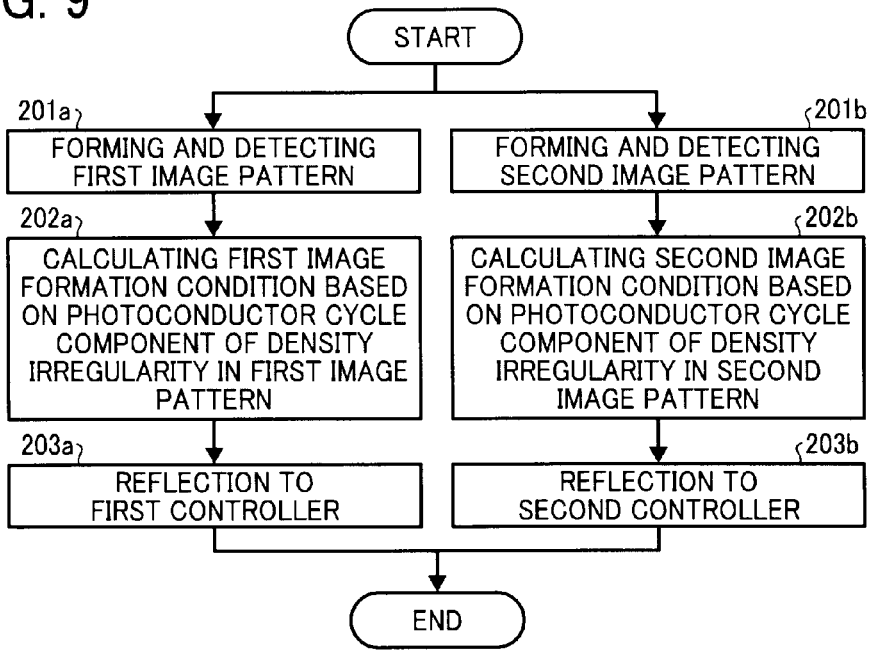
FIG. 9 is a flowchart showing correction control of density irregularity using the image patterns shown in FIG. 7.

FIG. 9 is a flowchart showing a sequence of correction control of density irregularity using image patterns 901 and 902 of FIG. 7 in the above-described image forming apparatus of FIG. 1. Because of forming the toner images of the image patterns 901 and 902 at positions opposed to the two different sensor heads 31*a* and 31*b* in this example of the control sequence, formation and detection of the image patterns 901 and 902 can be executed parallel (i.e., simultaneously). Specifically, unlike the control sequence of FIG. 8, the first image pattern formation and detection processing (step S201*a*) and the second image pattern formation and detection processing (step S201*b*) are executed in parallel substantially at the same time in the control sequence of FIG. 9. Therefore, series of processing staring from formation and detection of the image pattern to reflection of the image formation condition are independently executed parallel in first and second routes (from steps S201*a* to S203*a* and from steps S201*b* to S203*b*), respectively, in the control sequence of FIG. 9.

Figure 10:
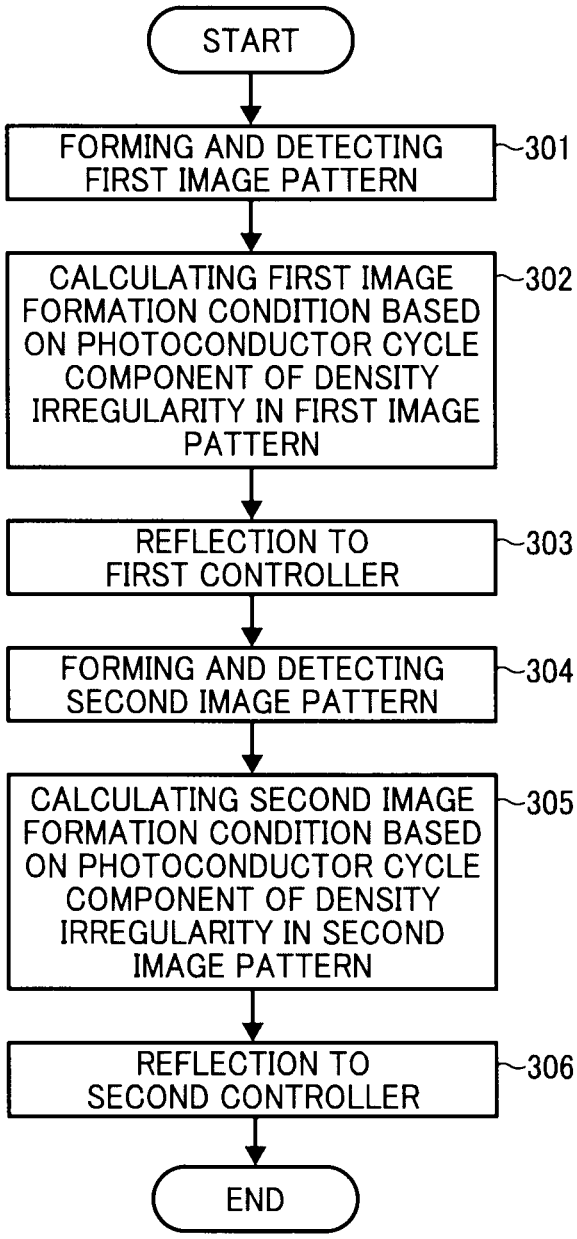
FIG. 10 is a flowchart illustrating yet another correction control of density irregularity.

FIG. 10 is a flowchart showing another correction control of density irregularity in the above-described image forming apparatus of FIG. 1. In this control sequence, toner image formation of second image pattern 902 is executed (in step S304) on condition that the toner image forming device has been controlled by the first controller in accordance with the first image formation condition (in steps S301 to S303). Because, the second image pattern 902 is formed on condition that the first image formation condition (i.e., a control table) has been reflected to the first controller (i.e., the controller 200), the first route (from steps S301 to S303) starting from the formation and detection of the first image pattern to reflection of the first image formation condition to the first controller (i.e., the controller 200) and the second route (from steps S304 to S306) starting from the formation and detection of the second image pattern to reflection of the second image formation condition to the second controller (i.e., the controller 200) are connected in series. With such control sequence of a processing system, adverse effect caused by control of the first controller onto the second image pattern 902 can be detected and (a problem solved image formation condition may be) reflected to the second controller as an advantage. Specifically, in theory, if a gain is determined appropriately when calculating the image formation condition (i.e., a control table), correction control is preferably executed just as the control sequence proceeds in FIGS. 8 and 9. However, since there is an individual difference between actual machines, a gain determined beforehand is not always optimum in the machines. Thus, correction control by the first controller can adversely affect density irregularity (detection) of the second image pattern 902. In contrast, however, with the control sequence of FIG. 10, the second image formation condition (i.e., a table control) can be determined by reducing density irregularity occurred in the second image pattern 902 as an advantage.

Figure 11:
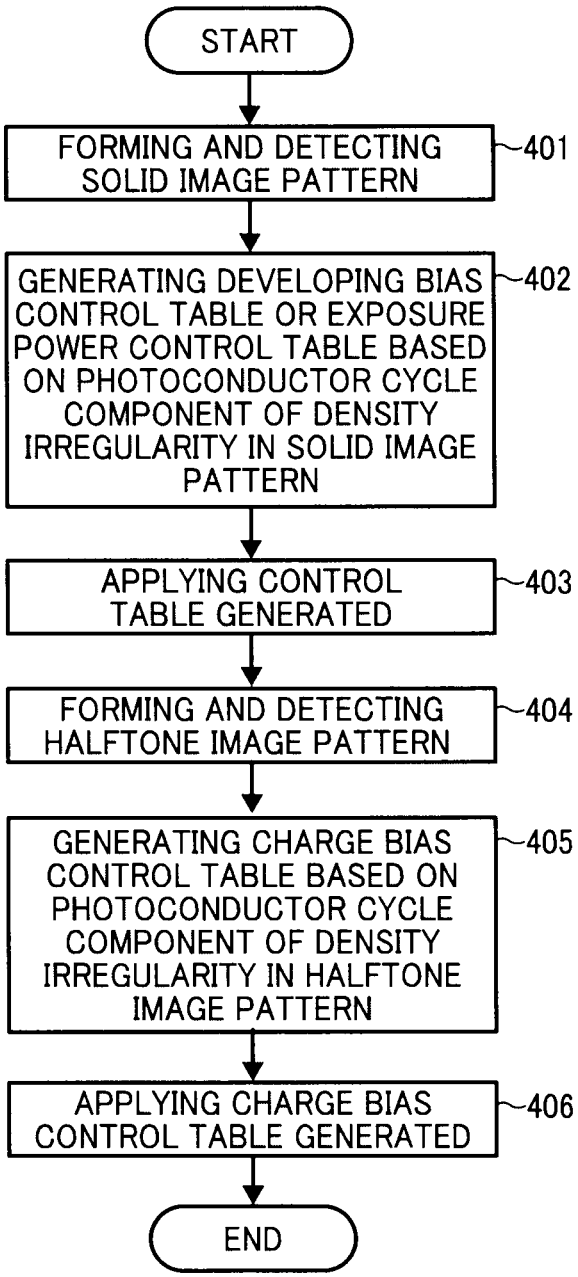
FIG. 11 is a flowchart illustrating yet another correction control of density irregularity.

FIG. 11 is a flowchart showing yet another correction control of density irregularity in the above-described image forming apparatus of FIG. 1. This control sequence is performed with first and second image patterns 902 and 901 having a different density level from the other and a single (the same) density pattern. In this embodiment, an image forming condition to be determined based on a pattern on a high density side may be a development condition (for example, a developing bias) of the developing units 5Y, 5M, 5C, 5K or an exposure condition (e.g., a charging bias).

In a control sequence of FIG. 11, a toner image of a typical solid image pattern (i.e., a first image pattern 901) as a high density side pattern is formed on the intermediate transfer belt 1, and density of the toner image of the solid image pattern is detected by the toner image detector 30 (in step S401). Then, based on a detection result of this toner image detector 30, a photoconductor periodic component of density irregularity of the solid image pattern is detected (i.e., extracted), and a calculation process of determining the exposure condition or the development condition as a first image forming condition is performed (in step S402) based on the photoconductor periodic component. In the illustrated example, a control table of a developing bias applied to a developing roller in the developer unit 5, or a table of exposure power used in the optical writing unit 4 is created. These two images forming condition control parameters (i.e., the developer bias and the exposure power) are effective in control density of a solid image. Thus, by applying the control table thus created with the control parameter (i.e., a control factor) to correction control executed by the controller 200 (in step S403), density irregularity of the solid image can be reduced.

On the other hand, when these control parameters (i.e., control factors) are fluctuated according to the control table in a photosensitive member cycle, a developing potential changes periodically and a ratio between it and a background potential varies, resulting in density irregularity in a halftone density section. Then, in the control sequence of FIG. 11, a halftone density image pattern is formed as a second image pattern on the intermediate transfer belt 1 on condition that the control parameters (i.e., the developer bias and the exposure power) of these two image formation conditions have been applied, and density of a toner image of the halftone density image pattern is detected by the toner image detector 30 (in step S404). Subsequently, based on a detection result of this toner image detector 30, a photoconductor periodic component of density irregularity of the halftone density image pattern is detected (i.e., extracted), and a calculation process of determining a charging condition as a second image forming condition is performed (in step S405) based on the photoconductor periodic component. For example, a control table of a charging bias as effective control parameter (i.e., a controlled factor) capable of fluctuating a background potential is created to be applied to the charger 3 as illustrated. Thus, by applying the control table of this charging bias to correction control executed by the controller 200 (in step S406), density irregularity occurring in the halftone density section can be reduced.

Alternatively, the lower half processing steps (i.e., steps S404 to S406) and the upper half processing steps (i.e., steps S401 to S403) of FIG. 11 can be swapped, so that correction control for the halftone image density irregularity precedes that of the solid image density irregularity. Specifically, the similar control as described above can be performed using halftone density and solid image patterns as the first and second image patterns, respectively. Further, an impact of the developing bias control table or the exposure power control table used for the solid image density control on (detection of) halftone density irregularity is more recognizable than that of the charging bias control table used for halftone density control on (detection of) solid image density irregularity. Thus, although the control sequence previously using the halftone density pattern as the first image pattern has the above-described difficulty, substantially the same control result can be obtained in the both of control sequences if a gain is appropriate when creating the control tables.

Further, each of the above-described control sequences of FIGS. 10 and 11 may be repeated multiple times. Because, in a practical machine, a relatively decreased gain is possibly designated when creating a control table to prevent excessive correction, and accordingly, image density irregularity cannot be completely removed by single correction control sometimes. In such a situation, by repeating series of correction control, the density irregularity can be further reduced. However, since image patterns are repeatedly drawn, there may be disadvantage in views of quick control and toner yield. Accordingly, the gain is more preferably designated to be able to provide effective control only by single correction without repeating the same.

Further, a rotation position detector (for example, a home position sensor or a rotary encoder) may be provided to detect a rotational position of the photoconductive drum 2 as a source of generating image irregularity in the above-described image forming apparatus to determine the above-described first and second image formation conditions and execute controlling synchronizing with a detection signal of the rotation position detector.

Figure 12:
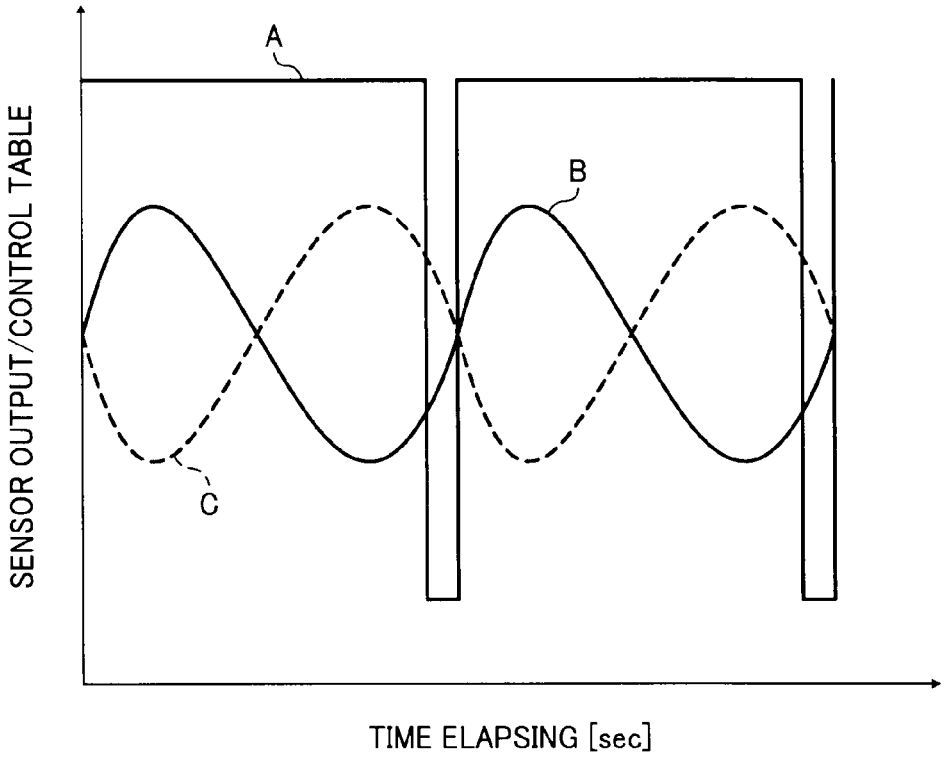
FIG. 12 is a chart showing a relation between a rotational position detection signal (A), a toner attracted amount detection signal (B) generated by a toner image detector, and a value (C) of an image formation condition (i.e., a control table)

To explain this in more detail, FIG. 12 is a graph to illustrate a relationship between a rotation position detection signal (A), a toner attracted amount detection signal (B) generated by a toner image detector 30, and a value (C) of an image formation condition (i.e., a control table) created based on the signal(s) when first and second image formation conditions are determined and (image density) control is executed synchronizing with a detection signal of the above-described rotation position detector. As illustrated, a signal is drawn for two cycles of the photoconductive drum 2. The toner attracted amount detection signal (B) is changing in the same cycle of the rotation position detection signal (A). Thus, the value of the image formation condition (i.e., a control table) is determined to have an almost reverse phase to that of the toner attracted amount detection signal (B). When a charging bias, a developing bias, and an exposure power practically used as parameter for image density control (i.e., a control factor) are each negative or a larger absolute value, toner attracted amount can decrease or the like. Therefore, the image formation condition (i.e., a control table) does not have a reversed phase precisely. In any way, a control table is created in this embodiment to cancel fluctuation in a toner attracted amount represented by the toner attracted amount detection signal (B).

An amount of the gain, specifically, a variation of a voltage [V] of the control table in relation to a variation of a voltage [V] of the toner attracted amount detection signal (B) is ideally sought from a theoretical value when determining the above-described control table. However, when practically employed in a real machine, verification is executed by the real machine based on the theoretical value, and the gain is likely determined based on experimental data, finally. The control table determined by the thus determined gain has a time relation with the rotation position detection signal (A) as shown in FIG. 12. Here, a head of the control table is supposed to be a point of generation of the rotation position detection signal (A). Further, when this control table is a development bias control table, a time to apply the control table needs to be determined considering a distance between a developing nip and the toner image detection sensor 30. Specifically, if the distance between a developing nip and the toner image detection sensor 30 is integer multiple of the circumference of the photoconductive drum 2, the control table is preferably applied from the head thereof synchronizing with the rotation position detection signal (A). Further, if the distance between the developing nip and the toner image detector is not the integer multiple of the circumference of the photoconductive drum 2, the control table is applied by changing an application time corresponding to a difference therebetween. Similarly, if the control table is an exposure power control table, the control table is applied considering a distance between an exposure position and a toner image detector. Further, if the control table is a charging bias control table, the control table is applied considering a distance between a charging position and the toner image detector.

Further, in the above-described image forming apparatus, an image formation condition can be determined (i.e., a table is updated and/or created) immediately after setting of the photoconductive drum 2 to a main body of the image forming apparatus (e.g. an initial setting time, a replacement time, a detachment or attachment time) for correction control of image irregularity as described with reference to FIGS. 8 to 12. Because, a generation aspect of irregularity of image density in a rotation cycle of the photoconductive drum 2 likely changes when the photoconductive drum 2 is physically removed in this situation. Further because, a positioning in relation to a photoconductor home position sensor installed becomes incorrect. When a latent-image bearer (i.e., a photoconductive drum) is initially set, and accordingly a control table has not been created originally, the control table needs to be created by executing series of correction control. Further, when the photoconductive drum 2 is replaced, a control table needs to be re-created according to a new photoconductive drum, because there are differences in vibration characteristics and light sensitivity irregularity in the new photoconductive drum from that ever used. Further, when the photoconductive drum 2 is simply detached and/or attached for a maintenance, a control table also needs to be re-created, because an attachment condition of the photoconductive drum 2 changes (e.g. deviation of an axis of a photoconductive drum from a rotary axis changes), or there are differences in vibration characteristics and light sensitivity irregularity in the new photoconductive drum from that ever used, or a positioning in relation to a photoconductor home position sensor installed becomes incorrect.

Further, in the above-described image forming apparatus, the image formation condition can be determined (i.e., a table is updated and/or created) each time a prescribed number of recording sheets 20 has been created, i.e., at a prescribed interval. Because, a photoconductor is increasingly degraded as the number of printed recording sheets 20 increases, and accordingly light sensitivity characteristic irregularity may change. Yet further, since a setting condition of the photoconductive drum 2 gradually changes (displaced) due to long time usage, an eccentricity caused by deviation of an axis of a photoconductive drum from a rotary axis possibly changes, and a positioning in relation to a photoconductor home position sensor installed becomes incorrect. Then, to cancel impacts of these deviations, an image formation condition can be determined (i.e., a control table is updated or created) each time a prescribed number of recording sheets 20 has been created, i.e., at a prescribed interval.

Further, the image formation condition can be determined (i.e., a table is update and/or created) when an environmental condition in the image forming apparatus with the above-described configuration changes. Especially, when temperature as an environmental condition changes, a photoconductor original pipe of the photoconductive drum 2 contracts or expands in accordance with a thermal expansion coefficient of the photoconductor original pipe. Accordingly, since an outline profile of the photoconductive drum 2 changes, the fluctuation of a development gap and density irregularity change. To handle these changes, the image formation condition is determined (i.e., a table is update and/or created) when the environmental condition changes. In such a situation, determination of an image formation condition (i.e., updating and/or creating of a table) is triggered when temperature changes after the last determination of image formation condition more than N [degree].

Figure 13:
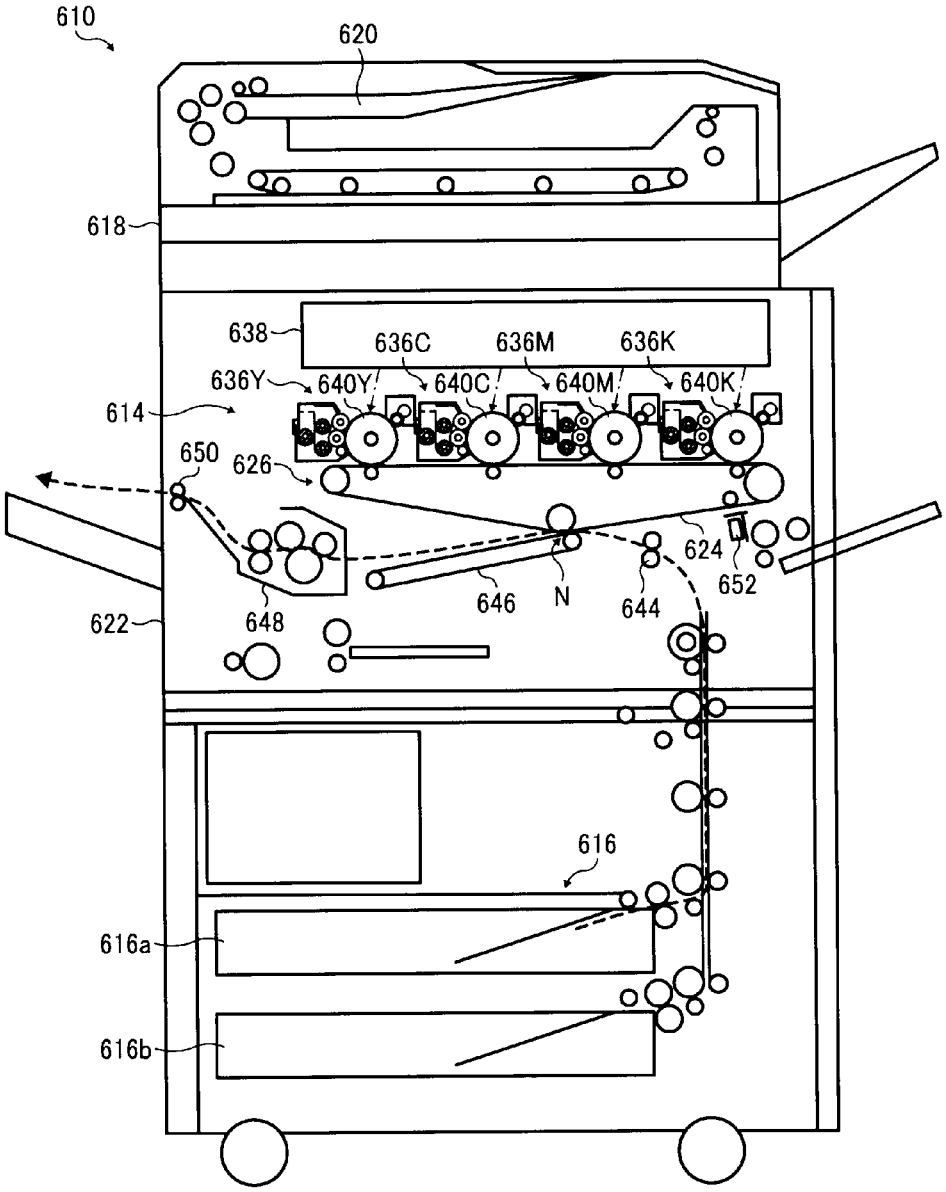
FIG. 13 is an overview of an image forming apparatus according to another embodiment of the present invention.
Figure 14:
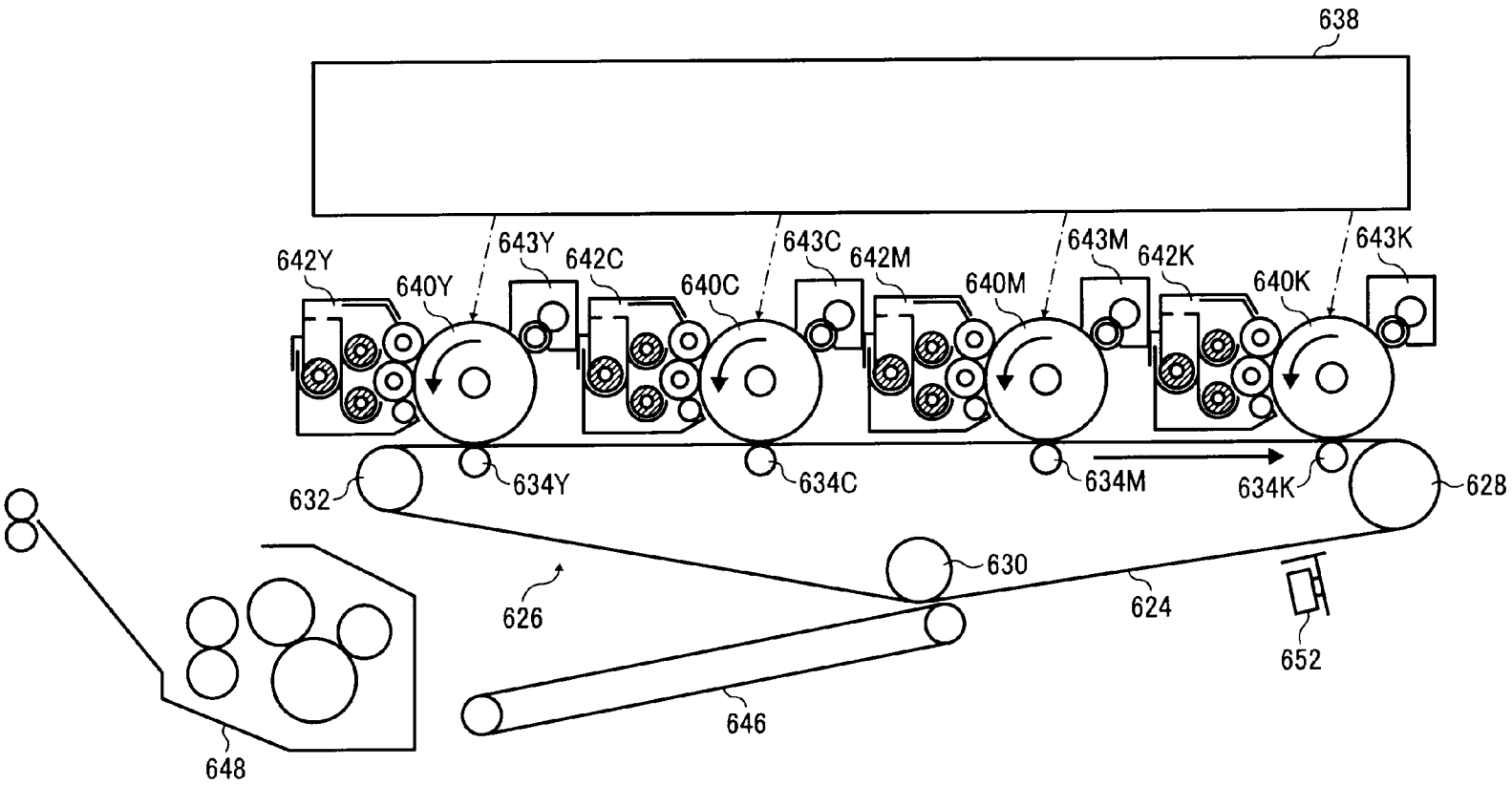
FIG. 14 is an enlarged view of an image formation section of the image forming apparatus of FIG. 1.

Now, yet another embodiment of the present invention described with reference to FIGS. 13 to 23. As shown, FIG. 13 schematically illustrates an image forming apparatus according to yet another embodiment, and FIG. 14 schematically illustrates an image formation section of FIG. 13. The image forming apparatus has substantially the same configuration and similarly operates as the earlier described various embodiments except for a developing system. The image forming apparatus 610 has an image formation unit 614 to form an image on a recording sheet 612, a sheet supplying device 616 to supply a sheet to the image formation unit 614, a scanner 618 to read a manuscript image, and an ADF (an automatic manuscript feeder) 620 to automatically feed the manuscript to the scanner 618 as shown in FIG. 13. The reference numeral 616*a* and 616*b* indicate sheet feeding trays 601 and 602, respectively, in FIG. 13. In the apparatus body 622, an intermediate transfer unit 626 having an intermediate transfer belt 624 stretched by multiple stretching rollers as a transfer device is disposed. The intermediate transfer belt 624 is made of material mainly composed of polyimide resin having small expansion with dispersion of carbon powder for adjusting an electric resistance thereof. The intermediate transfer belt 624 is stretched by the driven roller 628 and is endlessly driven by rotation of a driven roller 628 driven by a driving device, not shown in the drawing, a secondary transfer backup roller 630, a driven roller 632, and four primary transfer rollers 634Y(yellow), 634C(cyan), 634M (magenta), and 634K (black) as well.

Above the four process units 636Y, 636C, 636M, and 636K, an optical write unit 638 as an exposing device is disposed. In the optical write unit 638, four semiconductor lasers, not shown, are driven by a laser control unit, not depicted, and emit four writing light fluxes in accordance with image information. Drum-shaped photoconductors 640Y, 640C, 640M, and 640K as image bearers included in the process units 636Y, 636C, 636M, and 636K are scanned by the writing light fluxes in the dark, thereby writing electrostatic latent images Y, C, M, and K on surfaces of the photoconductors 640Y, 640C, 640M, and 640K, respectively. Although it is not shown, a photo interrupter is located as a rotation position detector to detect a rotation position of the photoconductor 640 in the image forming apparatus. The photo interrupter and its placement disclosed in Japanese Patent Publication No. 2000-098675 can be employed, for example. Although the rotational position of the photoconductor is detected using the photo interrupter in this embodiment, the rotational position can be detected by a rotary encoder or the like, as is not limited to this configuration.

In this embodiment, with the optical write unit 638, the laser light emitted from a semiconductor laser is optically scanned by reflecting the laser with a reflector and deflecting the laser with polygon mirror, not illustrated. However, an LED array may be used to execute optical scanning instead of the above-described device. The electrostatic latent images written on the photoconductors 640Y, 640M, 640C, and 640K are developed by toner stored in the developing device when the toner sticks to the photoconductors 640Y, 640M, 640C, and 640K due to its electrostatic attraction force. After that, toner images are sequentially superimposed on the intermediate transfer belt to form a desired image. A recording sheet is conveyed to a nip between rollers (i.e., a secondary transfer position) N constituting a secondary transfer device by a pair of registration rollers at a prescribed time. The recording sheet is then subjected to a secondary transfer process in which each color component image (i.e., four color-component toner images) is transferred and superimposed on the intermediate transfer belt at once, and is further transported by a conveyor belt 646. The recording sheet passes through a fixing unit 648 and the toner image is fixed to be a color printing image, and is discharged outside a machine by a pair of sheet ejection rollers 650. Further, volatile and nonvolatile memories, not shown, are installed in the image forming apparatus, in which various information pieces, such as correction control result, an output from each sensor, etc., are stored.

Figure 15A:
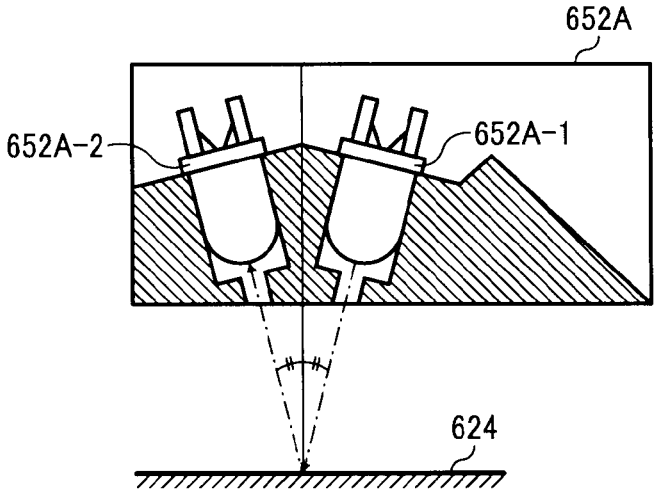
FIGS. 15A and 15B collectively show a configuration of a density irregularity detector.
Figure 15B:
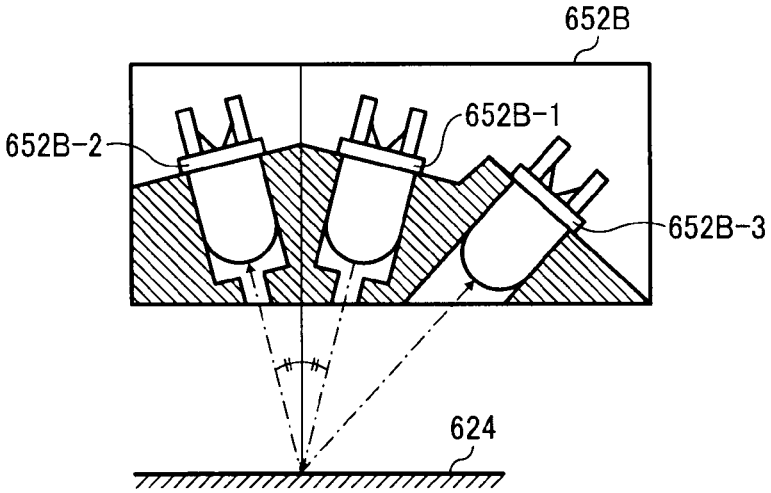
Figure 16:
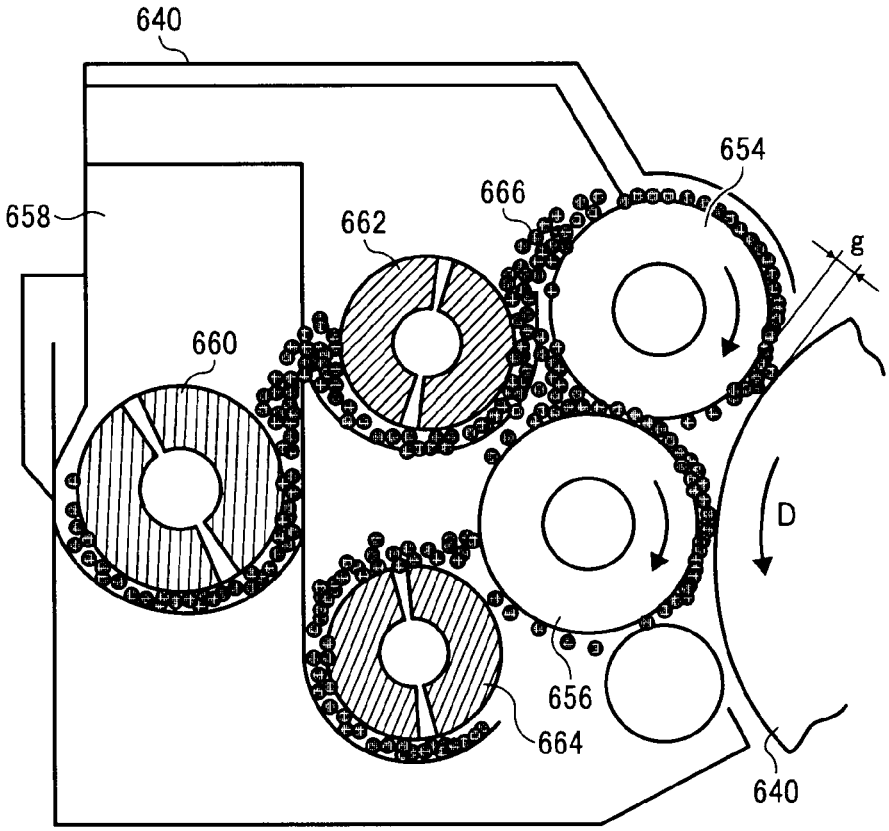
FIG. 16 is a schematic cross-sectional view of a developing device.

As shown in FIG. 13, a toner attracted amount detector 652 as a density detector is positioned upstream of a secondary transfer position in a rotation direction of an intermediate transfer belt 624 to detect density of an image on the intermediate transfer belt 624. The toner attracted amount detector 652 is schematically shown in FIGS. 15A and 15B. FIGS. 15A and 15B illustrate configurations of a black toner attracted amount detector 652A and a color attracted amount detector 652B, respectively. Substantially, the black toner attracted amount detector 652A acts as a positional deviation detector, while the color deposition amount detector 652B acts as a toner attracted amount detector. As shown in FIG. 15A, the black toner attracted amount detector 652A is composed of a light emitting element 652A-1 formed from a light-emitting diode (LED) or the like and a light-receiving element 652A-2 receiving regular reflection light. The light-emitting element 652A-1 emits light onto the intermediate transfer belt, and the light is then reflected by the intermediate transfer belt. The light-receiving element 652A-2 receives the regular reflection light among the reflected light.

On the other hand, as shown in FIG. 15B, the color attracted amount detector 652B is composed of a light emitter 652B-1 formed from a light-emitting diode (i.e., an LED) or the like, a light receiving element 652B-2 for receiving regular reflection light, and a light receiving element 652B-3 receiving diffusion reflection light. Like the black toner attracted amount detector, the light-emitting element 652B-1 emits light onto the intermediate transfer belt, and the light is reflected by the intermediate transfer belt surface. The regular reflection light-receiving element 652B-2 receives regular reflection light among the reflected light. The diffused reflection light receiving element 652B-3 receives diffusion reflection light among the reflected light. As a light-emitting element, a GaAs infrared light-emitting diode emitting light with peak wavelength at about 950 nm is used. As a light-receiving element, a Si-phototransistor with peak light receiving sensitivity at about 800 nm is used. However, the peak wavelength and peak light receiving sensitivity can be different from those. Further, there is a distance about 5 mm (a detection distance) between the black and color attracted amount detectors and the surface of the intermediate transfer belt as a detection object. In this embodiment, the toner attracted amount detector is disposed near the intermediate transfer belt, and the image formation condition is determined based on an amount of attracted toner on the intermediate transfer belt. However, the toner attracted amount detector can be disposed above the photoconductor and a transfer conveyor belt. An output from the toner attracted amount detector is converted to an attracted amount using conventional attracted amount conversion algorithm. Thus, the attracted amount conversion algorithm is not described here to avoid repetition.

On the other hand, as shown in FIG. 15B, the color attracted amount detector 652B is composed of a light emitter 652B-1 formed from a light-emitting diode (i.e., an LED) or the like, a light receiving element 652B-2 for receiving regular reflection light, and a light receiving element 652B-3 receiving diffusion reflection light. Like the black toner attracted amount detector, the light-emitting element 652B-1 emits light onto the intermediate transfer belt, and the light is reflected by the intermediate transfer belt surface. The regular reflection light-receiving element 652B-2 receives regular reflection light among the reflected light. The diffused reflection light receiving element 652B-3 receives diffusion reflection light among the reflected light. As a light-emitting element, a GaAs infrared light-emitting diode emitting light with peak wavelength at about 950 nm is used. As a light-receiving element, a Si-phototransistor with peak light receiving sensitivity at about 800 nm is used. However, the peak wavelength and peak light receiving sensitivity can be different from those. Further, there is a distance about 5 mm (a detection distance) between the black and color attracted amount detectors and the surface of the intermediate transfer belt as a detection object. In this embodiment, the toner attracted amount detector is disposed near the intermediate transfer belt, and the image formation condition is determined based on an amount of attracted toner on the intermediate transfer belt. However, the toner attracted amount detector can be disposed above the photoconductor and a transfer conveyor belt. An output from the toner attracted amount detector is converted to an attracted amount using conventional attracted amount conversion algorithm. Thus, the attracted amount conversion algorithm is not described here to avoid repetition.

A height of developer supplied onto the first and second developing rollers 654 and 656 is regulated by doctor blades, not shown, and the developer contacts the photoconductor 640 rotating in a direction as shown by an arrow D, and adheres toner to a latent image portion to develop thereof. When toner density of the developer 666 decreases, a toner replenishment unit, not shown, supplies toner to the developer vessel through an opening, not shown, formed above the stirring screw, and is stirred by the stirring screw. Each developing roller in the developing device is frequently electrically connected to each other using conductive material, not illustrated, to apply the same developing bias to each developing roller (see, Japanese Patent No. 2790988). In this embodiment, however, each developing roller in the developing device 642 is not electrically connected to the other, so that a different voltage can be applied to each developing roller. Although this embodiment employs a two-stage developing system, in which two developing rollers rotate in the same direction as the photoconductor, the present invention is not limited to this type. Further, although the two component developer is employed, the present invention is not limited to this type of developer.

Figure 17A:
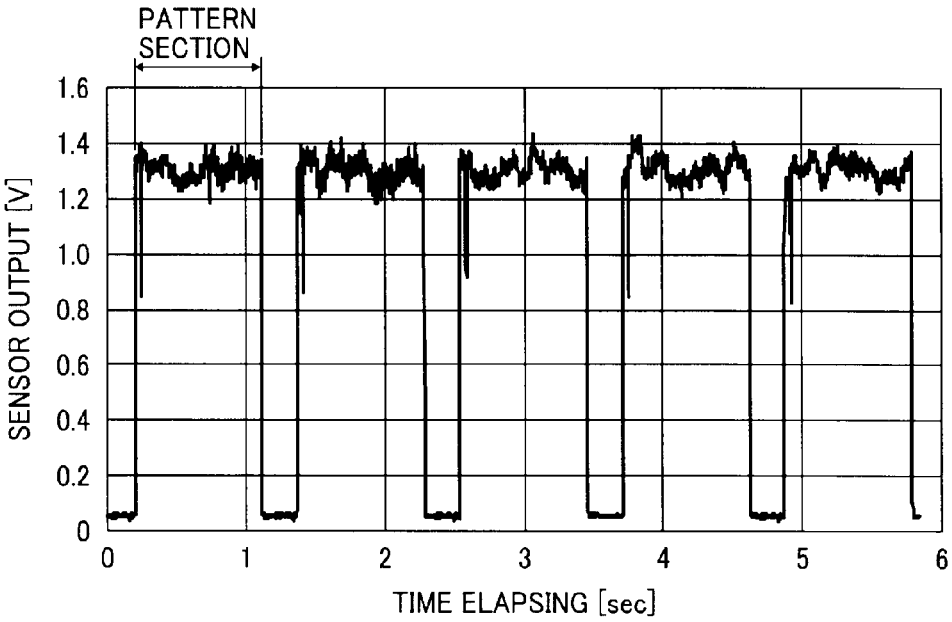
FIGS. 17A and 17B collectively show density irregularity caused by rotation run-out of a photoconductor.
Figure 17B:
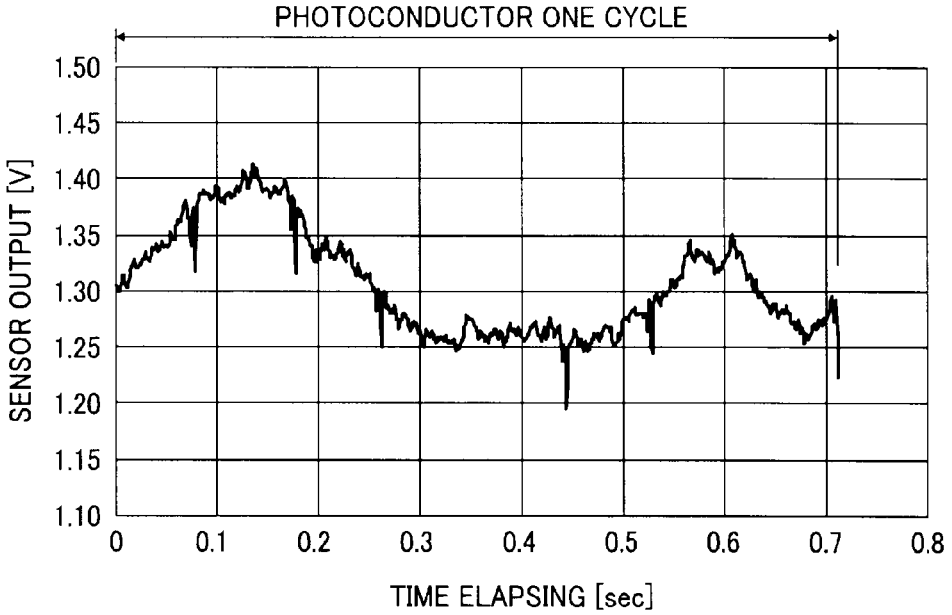
Figure 18:
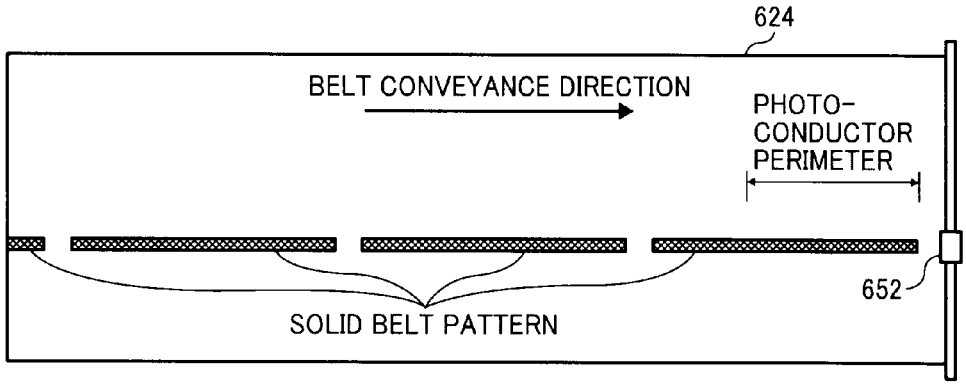
FIG. 18 is a diagram showing a belt-like solid image pattern.
Figure 19:
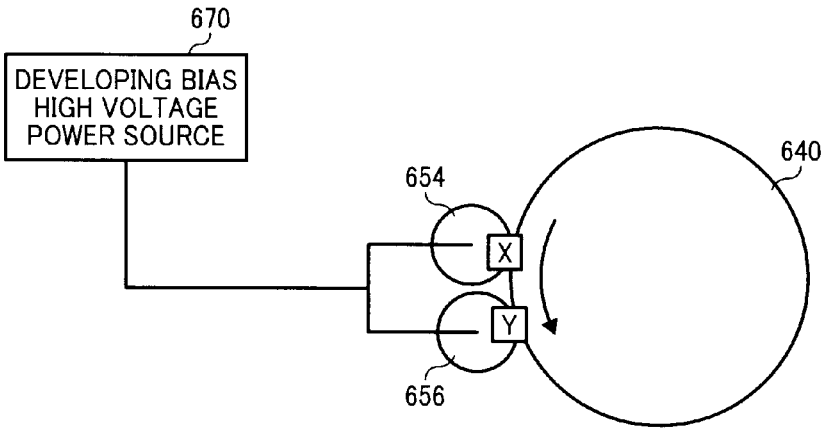
FIG. 19 is a diagram showing a system of applying a developing bias.

Now, one example of density irregularity caused by photoconductor rotation run-out is described with reference to FIGS. 17A and 17B. Initially, to confirm that density irregularity in a sub-scanning direction is caused by photoconductor rotation, an image of a slender belt-like pattern having uniform density is formed as shown in FIG. 18 by using the image forming apparatus of FIG. 13. The belt-like pattern is then measured by a toner attracted amount detector 652 as a density sensor. As shown, the belt-like pattern is sufficiently longer than the circumference of the photoconductive member in the sub-scanning direction. As an experiment, a belt-like pattern with 100% cyan is formed employing a photoconductor having a diameter of about 100 mm at a process line speed of about 440 mm/s with charging power, developing power, and LD power of about −700V, about −500V, and about 70%, respectively. FIG. 17A shows a diffusion reflection output of the density sensor. It is recognized from FIG. 17A that density fluctuation (i.e., irregularity) occurs in a pattern section. FIG. 17B is a graph showing outputs of the density sensor, i.e., density of a pattern section of FIG. 17A, extracted with reference to a detection signal of a rotational position of the photoconductor per cycle and are averaged for five cycles of the photoconductor. It is confirmed from FIG. 17B that periodic fluctuations occur in a photoconductor cycle. Since the fluctuation in the output from the density sensor represents variation of toner attracted amount, it is understood that image density fluctuates in the photoconductor cycle.

Figure 20:
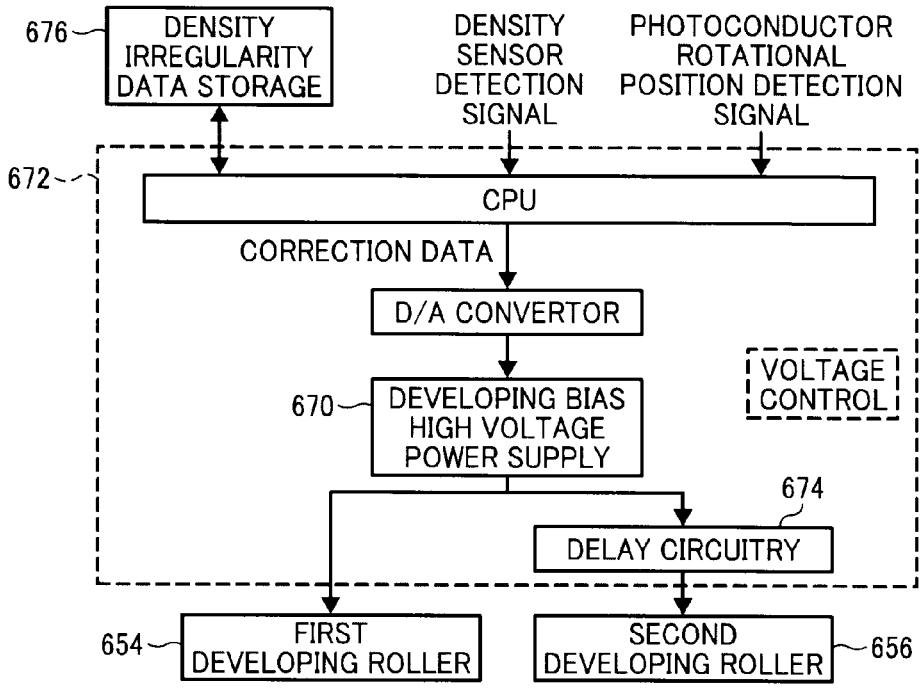
FIG. 20 is a block diagram showing a method of correcting the density irregularity according to another embodiment of the present invention.

Now, a voltage controller and a correction method of correcting density irregularity according to another embodiment are described with reference to FIG. 20. A voltage controller 672 is composed of a CPU, a D/A converter, a developing bias high voltage power source 670, and a delay circuit 674 or the like. The voltage controller 672 generates a density irregularity correction signal based on a density sensor detection signal and a photoconductor rotation position detection signal indicating the photoconductor rotational position, and controls a developing bias applied to the developing rollers in the multistage developing system in accordance with the photoconductor rotation position detection signal. Density irregularity data and its correction data are sequential stored in a density irregularity data storage 676 as a memory. Specifically, density irregularity data is averaged in a photoconductor cycle, and a phase and amplitude thereof is adjusted to eliminate this density irregularity and is fed back to a developing bias. The thus fed back developing bias is periodically applied to the developing roller consider a phase of a developing roller with reference to a photoconductor position. In this embodiment, the delay circuit 674 is disposed between the developing bias high voltage power source 670 and the developing roller 656 disposed downstream. Specifically, the correction data generated by the CPU is applied to each developing roller at the same time through the DA converter and the developing bias high voltage power source as well. However, a phase of a correction developing bias applied to the second developing roller is delayed from that applied to the first developing roller. The delay circuit 674 in this embodiment includes a simple RC circuitry and adjusts and delays a phase only for a time when a point on the photoconductor passes through a gap between developing rollers. However, this invention is not limited to the same, and another configuration can be employed if it can delay the phase.

Figure 21:
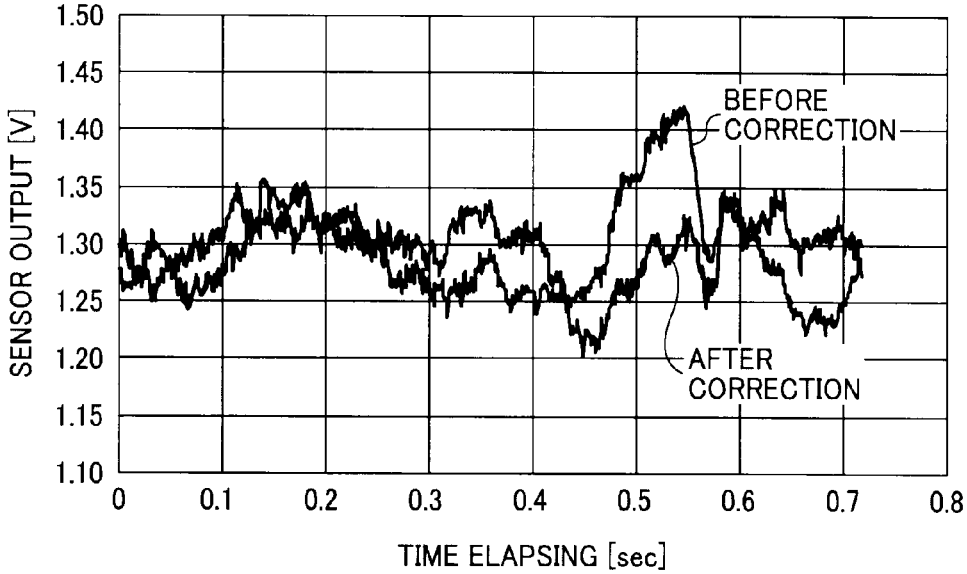
FIG. 21 is a graph showing a result of correction of the density irregularity according to another embodiment of the present invention.

FIG. 21 is an experimental result obtained when density irregularity method shown in FIG. 12 is applied to the image forming apparatus 610 as shown in FIG. 13. It is confirmed from correction result that an impact of the multi-stage developing roller and density irregularity caused by fluctuation of the photoconductor disappear, and density becomes almost uniform. Hence, it is proved that a method of correcting density irregularity of one embodiment of the present invention also effectively corrects the same in an image forming apparatus 610 that employs a multi-stage development system as a developing device.

Figure 22:
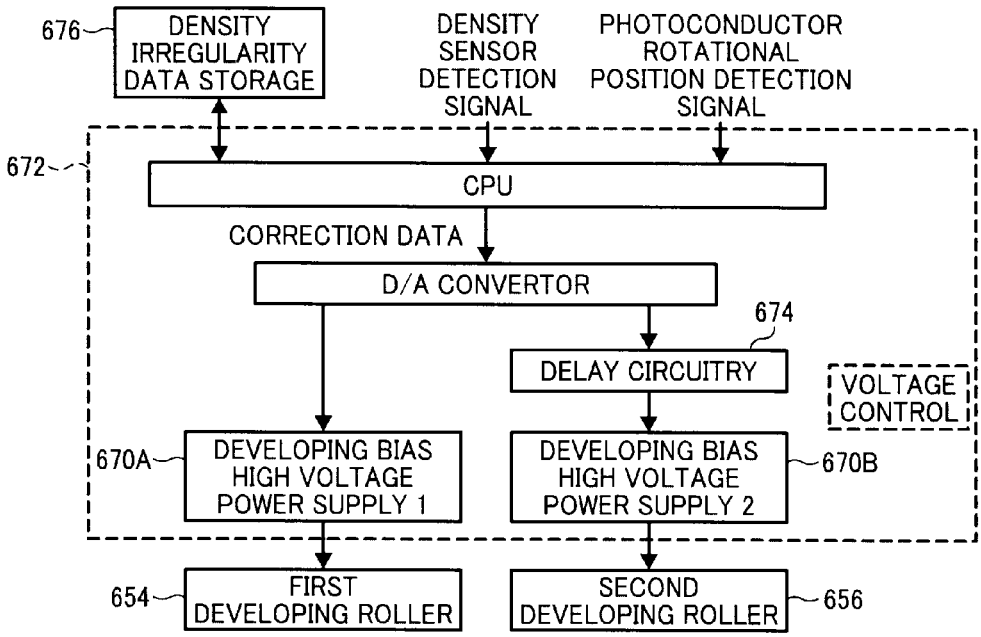
FIG. 22 is a block diagram showing another method of correcting the density irregularity according to yet another embodiment of the present invention.

Now, another embodiment is described with reference to FIG. 22, wherein like reference numerals and characters designate the same or corresponding parts to those described heretofore. This embodiment is characterized by the developing bias high voltage power source 670 being divided into a developing bias high voltage power source 670A corresponding to a first developing roller, and a second developing bias high voltage supply 670B corresponding to a second developing roller, while the delay circuit 74 is disposed between the DA converter and the developing bias high voltage power source 670A. With this configuration, the advantages of one of the embodiments of the present invention can be obtained without employing high-voltage use parts in the delay circuit. Further, since the delay circuit 674 can be placed on the same substrate as the developing bias high voltage power source 670, a space can be effectively used. Further, correction effectiveness in this embodiment is equivalent to that obtained in the former embodiment.

Figure 23:
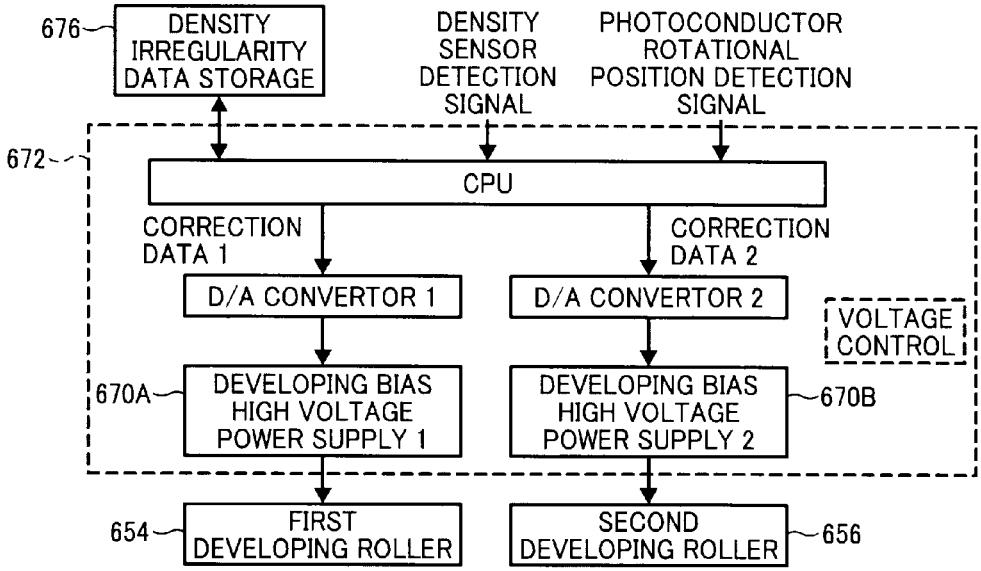
FIG. 23 is a block diagram showing yet another method of correcting the density irregularity according to yet another embodiment of the present invention.

Now, yet another embodiment is described with reference to FIG. 23. This embodiment is characterized in that two types of correction data 1 and data 2 are generated in a CPU, and developing biases having different phases from each other are applied to developing rollers, respectively. A phase difference between the correction data 1 and data 2 is equal to a time period when a photoconductor travels between the first and second developing rollers. With this configuration, an impact of phase variation caused by parts variation as a problem in the former embodiment can be absorbed. Further, correction effectiveness in this embodiment is also equivalent to that obtained in the former embodiment.

According to this invention, a toner image of a first image pattern preferable for correction control of density irregularity for one of different density images, i.e., high and low density side images, is formed on an image bearer. Then, a first image formation condition giving a greater impact on density irregularity of one of the images is determined based on a detection result of the toner image, and the toner image forming device is controlled based on the first image formation condition. With such control, density irregularity occurring in one of high and low density side image can be reduced. Further, a toner image of a second image pattern preferable for correction control of density irregularity for the other one of different density images, i.e., high and low density side images, is formed on the image bearer. Then, a second image formation condition giving a greater impact on density irregularity of the other one of the images is determined based on a detection result of the toner image, and the toner image forming device is controlled based on the second image formation condition. According to this invention, density irregularity occurring in multiple kinds of images having different density from each other can be appropriately reduced.

Numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

an image bearer to bear an image;

a toner image forming device to form a toner image on the image bearer;

a density detector to detect density of a toner image formed on the image bearer; and a processor that forms a first image pattern having a single density on the image bearer, determines a first fluctuation control table of a first image formation condition reducing density irregularity of the toner image based on a detection result of a periodical fluctuation of density of the first image pattern, and controls the toner image forming device based on the first fluctuation control table of the first image formation condition, and forms a second image pattern having a single density different from the density of the first image pattern on the image bearer, determines a second fluctuation control table of a second image formation condition reducing density irregularity of the toner image based on a detection result of a periodical fluctuation of density of the second image pattern, and controls the toner image forming device based on only the second fluctuation control table of the second image formation condition.

2. The image forming apparatus as claimed in claim 1, wherein the processor forms the second image pattern after controlling the toner image forming device based on the first image formation condition.

3. The image forming apparatus as claimed in claim 1, further comprising a controller to repeat first and second sequential processes, said first sequential process including toner image formation of the first image pattern, density detection of the first image pattern, determination of the first image formation condition, and controlling of the toner image formation based on the first image formation condition, said second sequential process including toner image formation of the second image pattern, density detection of the second image pattern, determination of the second image formation condition, and controlling of the toner image formation based on the second formation condition.

4. The image forming apparatus in claim 1, further comprising a rotation position detector that detects the rotational position of a rotating member serving as an image irregularity generation source and generates a detection signal, wherein the processor determines the first and second image formation conditions in synchrony with generation of the detection signal generated by the rotation position detector.

5. The image forming apparatus as claimed in claim 1, wherein a sequential process comprising toner image formation of the image pattern, density detection of the image pattern, and determination of the first and/or second image formation condition is executed after the image bearer is attached to a main body of the image forming apparatus and before the toner image formation onto the image bearer is started.

6. The image forming apparatus as claimed in claim 1, further comprising a transfer device to transfer a toner image formed on the image bearer onto a recording medium, wherein a sequential process comprising toner image formation, density detection, and determination of the first and/or second image formation condition based on the density detection result is executed each time a prescribed number of toner images are transferred onto recording media.

7. The image forming apparatus as claimed in claim 1, further comprising an environmental condition change detector to detect an environmental change in the image forming apparatus, wherein a sequential process comprising toner image formation, density detection, and determination of the first and/or second image formation condition based on the density detection result is executed each time environment changes in the image forming apparatus are detected by the environmental condition change detector.

8. The image forming apparatus as claimed in claim 1, wherein the first or second image pattern having the higher density determines a degree of fluctuated change in the developing and/or exposing conditions as the first image formation condition.

9. An image forming apparatus comprising:

an image bearer;

an exposing device to form a latent image on the image bearer;

a rotation position detector to detect a rotational position of the image bearer;

a developing device including at least one developing roller to render the latent image borne on the image bearer visible as a toner image;

a density irregularity detector to detect periodic density irregularity of a pattern image formed on the image bearer, said pattern image being longer than a circumference of the image bearer;

a storage device to store density irregularity information detected by the density irregularity density detector;

a processor that forms a first image pattern having a single density on the image bearer, determines a first fluctuation control table of a first image formation condition reducing density irregularity of the toner image based on a detection result of a periodical fluctuation of density of the first image pattern, and controls one of exposing and developing device based on the first fluctuation control table of the first image formation condition, and forms a second image pattern having a single density different from the density of the first image pattern on the image bearer, determines a second fluctuation control table of a second image formation condition reducing density irregularity of the toner image based on a detection result of a periodical fluctuation of density of the second image pattern, and controls one of exposing and developing device based on the second fluctuation control table of the second image formation condition.

10. The image forming apparatus as claimed in claim 9, wherein the developing device includes at least two developing rollers, and wherein a voltage controller applies voltages of different phases to the at least two developing rollers of the developing device.

11. The image forming apparatus as claimed in claim 9, wherein the developing device includes at least two developing rollers, and wherein a voltage controller controls phases of voltages applied to the at least two developing rollers to enable a cycle of the voltages applied to the at least two developing rollers coincide with a cycle of rotation of the image bearer.

12. The image forming apparatus as claimed in claim 9, wherein the developing device includes at least two developing rollers, and wherein a voltage controller increases a phase delay of the voltages applied to the at least two developing rollers the farther downstream the roller is provided in a rotation direction of the image bearer.

13. The image forming apparatus as claimed in claim 9, wherein the developing device includes at least two developing rollers, and wherein a voltage controller includes a delay circuit that delays a phase of a voltage applied to one of the at least two developing rollers provided downstream in a rotation direction of the image bearer from that applied to another of the at least two developing rollers provided upstream in the rotation direction.

14. The image forming apparatus as claimed in claim 13, wherein the delay circuit is provided between a high voltage power source and the one of the at least two developing rollers located downstream in the rotation direction of the image bearer.

15. The image forming apparatus as claimed in claim 9, wherein a voltage controller operates in synchrony with detection by the rotation position detector.

16. The image forming apparatus as claimed in claim 9, wherein the developing device includes at least two developing rollers, and the at least two developing rollers are electrically isolated from each other.

17. An image forming apparatus, comprising:

means for bearing an image;

means for forming a toner image on the image bearer;

means for detecting density of a toner image formed on the image bearing means; and processing means for forming a first image pattern having a single density on the image bearing means, determining a first fluctuation control table of a first image formation condition reducing density irregularity of the toner image based on a detection result of a periodical fluctuation of density of the first image pattern, and controlling the toner image forming means based on the first fluctuation control table of the first image formation condition, and forming a second image pattern having a single density different from the density of the first image pattern on the image bearing means, determining a second fluctuation control table of a second image formation condition reducing density irregularity of the toner image based on a detection result of a periodical fluctuation of density of the second image pattern, and controlling the toner image forming means based only on the second fluctuation control table of the second image formation condition.

18. The image forming apparatus as claimed in claim 17, wherein the processing means form the second image pattern after controlling the toner image forming means based on the first image formation condition.

19. The image forming apparatus as claimed in claim 17, further comprising means for repeating first and second sequential processes, said first sequential process including toner image formation of the first image pattern, density detection of the first image pattern, determination of the first image formation condition, and controlling of the toner image forming means based on the first image formation condition, said second sequential process including toner image formation of the second image pattern, density detection of the second image pattern, determination of the second image formation condition, and controlling of the toner image forming means based on the second formation condition.

* * * * *